US009273887B2

(12) United States Patent
Kroliczek et al.

(10) Patent No.: US 9,273,887 B2
(45) Date of Patent: Mar. 1, 2016

(54) EVAPORATORS FOR HEAT TRANSFER SYSTEMS

(75) Inventors: Edward J. Kroliczek, Davidsonville, MD (US); Michael Nikitkin, Ellicott City, MD (US); David A. Wolf, Sr., Baltimore, MD (US)

(73) Assignee: Orbital ATK, Inc., Dulles, VA (US)

( * ) Notice: Subject to any disclaimer, the term of this patent is extended or adjusted under 35 U.S.C. 154(b) by 640 days.

(21) Appl. No.: 13/421,524

(22) Filed: Mar. 15, 2012

(65) Prior Publication Data

US 2012/0175087 A1 Jul. 12, 2012

Related U.S. Application Data

(60) Division of application No. 10/676,265, filed on Oct. 2, 2003, now Pat. No. 8,136,580, and application No. 13/421,524, which is a continuation-in-part of application No. 10/602,022, filed on Jun. 24, 2003, (Continued)

(51) Int. Cl.

| | |
|---|---|
| ***B21D 53/02*** | (2006.01) |
| ***F25B 23/00*** | (2006.01) |
| ***F28D 15/04*** | (2006.01) |

(52) U.S. Cl.

CPC ..... *F25B 23/006* (2013.01); *F28D 15/043* (2013.01); *Y10T 29/4935* (2015.01)

(58) Field of Classification Search

CPC .. F25B 23/006; F28D 15/043; Y10T 29/4935
USPC ..... 29/890.03
See application file for complete search history.

(56) References Cited

U.S. PATENT DOCUMENTS

| | | | | |
|---|---|---|---|---|
| 2,051,723 | A * | 8/1936 | Kohler | 62/487 |
| 3,490,718 | A | 1/1970 | Vary | |
| 3,613,778 | A | 10/1971 | Feldman | |
| 3,661,202 | A | 5/1972 | Moore | |
| 3,677,336 | A | 7/1972 | Moore | |

(Continued)

FOREIGN PATENT DOCUMENTS

| | | |
|---|---|---|
| DE | 19941398 | 8/2000 |
| EP | 0210337 | 2/1987 |

(Continued)

OTHER PUBLICATIONS

Baumann, Jane, et al., "A methodology for enveloping reliable start-up of LHPs," AIAA Paper 2000-2285 (AIAA Accession No. 33681), AIAA Thermophysics Conference, 34th, Denver, CO, Jun. 19-22, 2000.

(Continued)

*Primary Examiner* — Jacob Cigna
(74) *Attorney, Agent, or Firm* — TraskBritt

(57) ABSTRACT

A heat transfer system includes an evaporator having a heated wall, a liquid barrier wall containing working fluid, a primary wick positioned between the heated wall and an inner side of the liquid barrier wall, a vapor removal channel located at an interface between the primary wick and the heated wall, and a liquid flow channel located between the liquid barrier wall and the primary wick. Methods of transferring heat include applying heat energy to a vapor barrier wall, flowing liquid through a liquid flow channel, pumping the liquid from the liquid flow channel through a primary wick, and evaporating at least some of the liquid at a vapor removal channel.

19 Claims, 19 Drawing Sheets

Related U.S. Application Data now Pat. No. 7,004,240, and application No. 13/421,524, Mar. 15, 2012, which is a continuation-in-part of application No. 09/896,561, filed on Jun. 29, 2001, now Pat. No. 6,889,754.

(60) Provisional application No. 60/415,424, filed on Oct. 2, 2002, provisional application No. 60/391,006, filed on Jun. 24, 2002, provisional application No. 60/215,588, filed on Jun. 30, 2000.

(56) References Cited

U.S. PATENT DOCUMENTS

| | | | | |
|---|---|---|---|---|
| 3,734,173 | A | | 5/1973 | Moritz |
| 3,756,903 | A | | 9/1973 | Jones |
| 3,792,318 | A | | 2/1974 | Fries et al. |
| 3,803,688 | A | | 4/1974 | Peck |
| 3,884,293 | A | | 5/1975 | Pessolano et al. |
| 3,948,316 | A | | 4/1976 | Souriau |
| 4,005,297 | A | | 1/1977 | Cleaveland |
| 4,046,190 | A | | 9/1977 | Marcus et al. |
| 4,087,893 | A | | 5/1978 | Sata et al. |
| 4,116,266 | A | | 9/1978 | Sawata et al. |
| 4,138,847 | A | | 2/1979 | Hill |
| 4,170,262 | A | | 10/1979 | Marcus et al. |
| 4,467,861 | A | | 8/1984 | Kiseev et al. |
| 4,470,450 | A | * | 9/1984 | Bizzell et al. ..... 165/104.25 |
| 4,470,451 | A | | 9/1984 | Alario et al. |
| 4,503,483 | A | | 3/1985 | Basiulis |
| 4,515,209 | A | * | 5/1985 | Maidanik et al. ..... 165/104.22 |
| 4,685,512 | A | | 8/1987 | Edelstein et al. |
| 4,765,396 | A | | 8/1988 | Seidenberg |
| 4,770,238 | A | | 9/1988 | Owen |
| 4,785,875 | A | | 11/1988 | Meijer et al. |
| 4,819,719 | A | | 4/1989 | Grote et al. |
| 4,830,718 | A | | 5/1989 | Stauffer |
| 4,854,379 | A | | 8/1989 | Shaubach et al. |
| 4,862,708 | A | | 9/1989 | Basiulis |
| 4,869,313 | A | * | 9/1989 | Fredley ..... 165/41 |
| 4,883,116 | A | | 11/1989 | Seidenberg et al. |
| 4,890,668 | A | | 1/1990 | Cima |
| 4,898,231 | A | | 2/1990 | Miyazaki |
| 4,899,810 | A | | 2/1990 | Fredley |
| 4,934,160 | A | | 6/1990 | Mueller |
| 5,002,122 | A | | 3/1991 | Sarraf et al. |
| 5,016,705 | A | | 5/1991 | Bahrle et al. |
| 5,103,897 | A | | 4/1992 | Cullimore et al. |
| 5,275,232 | A | | 1/1994 | Adkins et al. |
| 5,303,768 | A | | 4/1994 | Alario et al. |
| 5,335,720 | A | | 8/1994 | Ogushi et al. |
| 5,642,776 | A | | 7/1997 | Meyer et al. |
| 5,725,049 | A | | 3/1998 | Swanson et al. |
| 5,761,037 | A | | 6/1998 | Anderson et al. |
| 5,769,154 | A | | 6/1998 | Adkins et al. |
| 5,771,967 | A | | 6/1998 | Hyman |
| 5,816,313 | A | | 10/1998 | Baker |
| 5,842,513 | A | | 12/1998 | Maciaszek et al. |
| 5,899,265 | A | | 5/1999 | Schneider et al. |
| 5,944,092 | A | | 8/1999 | Van Oost |
| 5,947,193 | A | | 9/1999 | Adkins et al. |
| 5,950,710 | A | | 9/1999 | Liu |
| 5,966,957 | A | | 10/1999 | Malhammar et al. |
| 6,058,711 | A | | 5/2000 | Maciaszek et al. |
| 6,205,803 | B1 | | 3/2001 | Scaringe |
| 6,227,288 | B1 | | 5/2001 | Gluck |
| 6,330,907 | B1 | | 12/2001 | Ogushi et al. |
| 6,347,523 | B1 | | 2/2002 | Barrash et al. |
| 6,378,313 | B2 | | 4/2002 | Barrash |
| 6,381,135 | B1 | | 4/2002 | Prasher |
| 6,382,309 | B1 | | 5/2002 | Kroliczek et al. |
| 6,397,936 | B1 | | 6/2002 | Crowley |
| 6,415,627 | B1 | | 7/2002 | Pfister et al. |
| 6,450,132 | B1 | | 9/2002 | Yao et al. |
| 6,450,162 | B1 | | 9/2002 | Wang et al. |
| 6,533,029 | B1 | | 3/2003 | Phillips |
| 6,591,902 | B1 | | 7/2003 | Trent |
| 6,596,035 | B2 | | 7/2003 | Gutkowski et al. |
| 6,615,912 | B2 | | 9/2003 | Garner |
| 6,626,231 | B2 | | 9/2003 | Cluzet et al. |
| 6,810,946 | B2 | | 11/2004 | Hoang |
| 6,840,304 | B1 | | 1/2005 | Kobayashi et al. |
| 6,863,117 | B2 | | 3/2005 | Valenzuela |
| 6,865,897 | B2 | | 3/2005 | Jibb |
| 6,889,754 | B2 | | 5/2005 | Kroliczek et al. |
| 6,931,863 | B2 | | 8/2005 | Chen et al. |
| 7,004,240 | B1 | | 2/2006 | Kroliczek et al. |
| 7,051,794 | B2 | | 5/2006 | Luo |
| 7,207,178 | B2 | | 4/2007 | Steinmeyer |
| 7,210,832 | B2 | | 5/2007 | Huang |
| 7,240,496 | B2 | | 7/2007 | Frank et al. |
| 7,251,889 | B2 | | 8/2007 | Kroliczek et al. |
| 7,268,744 | B1 | | 9/2007 | Short, Jr. et al. |
| 7,461,688 | B2 | | 12/2008 | Huang et al. |
| 7,487,643 | B2 | | 2/2009 | Chen et al. |
| 7,503,185 | B2 | | 3/2009 | Narayanamurthy et al. |
| 7,543,629 | B2 | | 6/2009 | Chin et al. |
| 7,549,461 | B2 | | 6/2009 | Kroliczek et al. |
| 7,661,464 | B2 | | 2/2010 | Khrustalev et al. |
| 7,708,053 | B2 | | 5/2010 | Kroliczek et al. |
| 7,775,261 | B2 | | 8/2010 | Valenzuela |
| 7,823,629 | B2 | | 11/2010 | Rosenfeld et al. |
| 7,827,807 | B2 | | 11/2010 | Narayanamurthy et al. |
| 7,931,072 | B1 | | 4/2011 | Kroliczek et al. |
| 8,047,268 | B1 | | 11/2011 | Kroliczek et al. |
| 8,066,055 | B2 | | 11/2011 | Kroliczek et al. |
| 8,109,325 | B2 | | 2/2012 | Kroliczek et al. |
| 8,752,616 | B2 | | 6/2014 | Kroliczek et al. |
| 2001/0039802 | A1 | | 11/2001 | Barrash |
| 2002/0062648 | A1 | | 5/2002 | Ghoshal |
| 2003/0051857 | A1 | | 3/2003 | Cluzet et al. |
| 2004/0182550 | A1 | | 9/2004 | Kroliczek et al. |
| 2004/0206479 | A1 | | 10/2004 | Kroliczek et al. |
| 2005/0005617 | A1 | | 1/2005 | Jibb |
| 2005/0061487 | A1 | | 3/2005 | Kroliczek et al. |
| 2005/0155356 | A1 | | 7/2005 | Frank et al. |
| 2005/0160744 | A1 | | 7/2005 | Frank et al. |
| 2005/0166399 | A1 | | 8/2005 | Kroliczek et al. |
| 2006/0185825 | A1 | | 8/2006 | Chen et al. |
| 2007/0028626 | A1 | | 2/2007 | Chen |
| 2012/0017625 | A1 | | 1/2012 | Kroliczek et al. |
| 2013/0101492 | A1 | | 4/2013 | McAlister |

FOREIGN PATENT DOCUMENTS

| | | | | |
|---|---|---|---|---|
| EP | 0355921 | B1 | | 7/1994 |
| EP | 0700737 | A2 | | 3/1996 |
| EP | 0987509 | A1 | | 3/2000 |
| EP | 1084688 | A3 | | 8/2001 |
| HU | 212748 | B | | 9/1995 |
| JP | 63036862 | | | 3/1988 |
| JP | 2000-055577 | | | 2/2000 |
| JP | 2000241089 | | | 9/2000 |
| RU | 2098733 | | | 3/1995 |
| RU | 2098733 | C1 | * | 12/1997 |
| SU | 505858 | | | 5/1976 |
| SU | 1467354 | | | 1/1987 |
| SU | 1834470 | A1 | | 7/1995 |
| WO | 0210661 | A1 | | 2/2002 |
| WO | WO 0210661 | A1 | * | 2/2002 |
| WO | 03054469 | | | 7/2003 |
| WO | 2004031675 | | | 4/2004 |
| WO | 2004040218 | | | 5/2004 |
| WO | 2005043059 | | | 5/2005 |

OTHER PUBLICATIONS

Berchowitz, D.M., et al., "Recent Advanced in Stirling Cycle Refrigeration," 1995, 19th International Conference of Refrigeration, The Hague, The Netherlands, 8 pages.

Berchowitz, D.M., Ph. D., "Maximized Performance of Stirling Cycle Refrigerators," Natural working fluids '98 IIR—Gustav Lorentzen Conference: Oslo, Norway, Jun. 2-5, 1998, Fluides actifs naturels conference IIF-Gustav Lorentzen Journal: Science et technique du froid, 1998 (4) 422-429.

(56) References Cited

OTHER PUBLICATIONS

Berchowitz, David M., "Free-Piston Rankine Compression and Stirling Cycle Machines for Domestic Refrigeration," Presented at the Greenpeace Ozon Safe Conference, Washington, DC, Oct. 18-19, 1993.
Berchowitz, David M., et al., "Design and Testing of a 40 W Free-Piston Stirling Cycle Cooling Unit," 20th International Conference of Refrigeration, IIR/IIF, Sydney, 1999, 7 pages, Australia.
Bienert, W.B., et al., "The Proof-of-Feasibility of Multiple Evaporator Loop Heat Pipes," 6th European Symposium on Environmental Systems, May 1997, 6 pages, Noordwijk, NL.
Bugby, D., et al., "Across-Gimbal and Miniaturized Cryogenic Loop Heat Pipes," CP654, Space Technology and Applicatons International Forum—STAIF 2003, edited by M.S. El-Genk, American Institute of Physics, 2003, pp. 218-226.
Bugby, D., et al., "Advanced Components and Techniques for Cryogenic Integration," Environmental systems—International conference; 31st Society of Automotive Engineers New York, 2001-01-2378, Orlando, FL Jul. 2001, 9 pages.
Bugby, D., et al., "Advanced Components and Techniques for Cryogenic Integration," presented at 2002 Spacecraft Thermal Control Symposium by Swales Aerospace, El Segundo, CA, Mar. 2002, 14 pages.
Bugby, D., et al., "Advanced Components for Cryogenic Integration," Cryocoolers 12, edited by R.G. Ross, Jr., Kluwer Academic/Plenum Publishers, 2003, pp. 693-708.
Bugby, D., et al., "Advanced Components for Cryogenic Integration," Proceedings of the 12th International Cryocooler Conference held Jun. 18-20, 2002, in Cambridge, MA, 15 pages.
Bugby, D., et al., "Development and Testing of a Gimbal Thermal Transport System," Proceedings of the 11th International Cryocooler Conference held Jun. 20-22, 2000, in Keystone, Colorado, 11 pages.
Bugby, D., et al., "Development of Advanced Cryogenic Integration Solutions," presented at the 10th International Cryocoolers Conference on May 26-28, 1998, in Monterey, CA, and published in "Cryocoolers 10," by Ron Ross, Jr., Kluwer Academic/Plenum Publishers, NY 1999, 17 pages.
European Search Report for Application No. EP 04 01 6584 dated May 15, 2006, 4 pages, European Patent Office, The Hague, Netherlands.
Hoang, "Advanced Capillary Pumped Loop (A-CPL) Project Summary," Contract No. NAS5-98103, Mar. 1994, pp. 1-37, TTH Research, Inc., Laurel, MD.
Hoang, Triem T., "Design and Test of a Proof-of-Concept Advanced Capillary Pumped Loop," Society of Automotive Engineers, presented at the 27th Environmental Systems International Conference, New York, 1997, Paper 972326, 6 pages.
Hoang, Trung T., et al., "Development of an Advanced Capillary Pumped Loop," Society of Automotive Engineers, presented at the 27th Environmental Systems International Conference, New York, 1997, Paper 972325, 6 pages.
Janssen, Martien, et al., "Measurement and application of performance characteristics of a Free Piston Stirling Cooler," 9th International Refrigeration and Air Conditioning Conference, Jul. 16-19, 2002, 8 pages, Purdue University, West Lafayette, IN.
Kim, Seon-Young, et al., "The Application of Stirling Cooler to Refrigeration," IECEC-97—Intersociety Energy Conversion Engineering Conference, 1997, Conference 32, vol. 2, pp. 1023-1026, Seoul, Korea.
Kotlyarov, E. Yu, et al., "Methods of Increase of the Evaporators Reliability for Loop Heat Pipes and Capillary Pumped Loops," 24th International Conference on Environmental Systems, Jun. 20-23, 1994, 15 pages, Friedrichshafen, Germany.
Ku, J., "Recent Advances in Capillary Pumped Loop Technology," 1997 National Heat Transfer Conference, Baltimore, MD, Aug. 10-12, 1997, AIAA 97-3870, 22 pages.
Ku, J., et al., "A high power spacecraft thermal management system," AIAA-1988-2702, Thermophysics, Plasmadynamics and Lasers Conference, San Antonio, TX Jun. 27-29, 1988, 12 pages.
Ku, J., et al., "An Improved High Power Hybrid Capillary Pumped Loop," paper submitted to SAE 19th Intersociety Conference on Environment Systems, SAE 891566, San Diego, CA, Jul. 24-27, 1989, 10 pages.
Ku, J., et al., "Testing of a Capillary Pumped Loop with Multiple Parallel Starter Pumps," SAE Paper No. 972329, 1997, Lake Tahoe, NV.
Ku, J., et al., "The Hybrid Capillary Pumped Loop," paper submitted to SAE 18th Intersociety Conference on Environmental Systems, SAE 881083, San Francisco, CA, Jul. 11-13, 1988, 11 pages.
Ku, Jentung, "Operational Characteristics of Loop Heat Pipes," NASA Goddard Space Flight Center; SAE Paper 99-01-2007, 29th International Conference on Environmental Systems, Denver, Colorado, Jul. 12-15, 1999; Society of Automotive Engineers, Inc.
Kwon, Yong-Rak, et al., "Operational Characteristics of Stirling Machinery," International Congress of Refrigeration, Aug. 17-22, 2003, 8 pages, Washington, D.C.
McCabe, Michael E., Jr., et al., "Design and Testing of a High Power Spacecraft Thermal Management System," National Aeronautics and Space Administration (NASA), NASA Technical Memorandum 4051, Scientific and Technical Information Division, 1988, 107 pages.
O'Connell, et al., "Hydrogen Loop Pipe Design & Test Results," presented at 2002 Spacecraft Thermal Control Symposium by TTH Research, El Segundo, CA, Mar. 2002, 14 pages.
Oguz, Emre, et al., "Experimental Investigation of a Stirling Cycle Cooled Domestic Refrigerator," 9th Proceedings of the International Refrigeration and Air Conditioning Conference at Purdue, 2002; 9th, vol. 2, pp. 777-784, West Lafayette, IN.
PCT International Preliminary Examination Report (Application No. PCT/US03/34165) mailed Mar. 8, 2007, 4 total pages.
PCT International Search Report (Application No. PCT/US04/35548) mailed Oct. 11, 2005, 11 total pages.
Russian Office Action for related Russian Application No. 2005116246, issued Oct. 9, 2008, Federal Institute of Industrial Property, Moscow, Russian Federation.
Van Oost et al., "Design and Experimental Results of the HPCPL," ESTEC CPL-96 Workshop, Noordwijk, Netherlands, 1996, 19 pages.
Van Oost, Stephane, et al., "Test Results of Reliable and Very High Capillary Multi-Evaporators/Condenser Loop," 25th International Conference on Environmental Systems, Jul. 10-13, 1995, 12 pages, San Diego, CA.
Welty, Stephen C., et al., "Energy Efficient Freezer Installation Using Natural Working Fluids and a Free Piston Stirling Cooler," VI Congreso Iberoamericano De Aire Acondicionado Y Refrigeration, CIAR 2001, Trabajo No. 96, pp. 199-208, Aug. 15-17, 2001, Buenos Aires, AR.
Yun, James, et al., "Development of a Cryogenic Loop Heat Pipe (CLHP) for Passive Optical Bench Cooling Applications," 32nd International Conference on Environmental Systems (ICES-2002), Society of Automotive Engineers Paper No. 2002-01-2507, San Antonio, Texas, 2002, 9 pages.
Yun, James, et al., "Multiple Evaporator Loop Heat Pipe," Society of Automotive Engineers, 2000-01-2410, 30th International Conference on Environmental Systems, Jul. 10-13, 2000, 10 pages, Toulouse, FR.
Yun, S., et al., "Design and Test Results of Multi-Evaporator Loop Heat Pipes," SAE Paper No. 1999-01-2051, 29th International Conference on Environmental Systems, Jul. 1999, 7 pages, Denver CO.

* cited by examiner

EVAPORATORS FOR HEAT TRANSFER SYSTEMS

CROSS-REFERENCE TO RELATED APPLICATIONS

This application is a divisional of U.S. patent application Ser. No. 10/676,265, filed Oct. 2, 2003, now U.S. Pat. No. 8,136,580, issued Mar. 20, 2012, which application claims the benefit of U.S. Provisional Patent Application Ser. No. 60/415,424, filed Oct. 2, 2002, the disclosure of each of which is hereby incorporated herein in its entirety by this reference.

This application is also related to U.S. patent application Ser. No. 12/650,394, filed Dec. 30, 2009, now U.S. Pat. No. 8,109,325, issued on Feb. 7, 2012, which is a continuation-in-part of U.S. patent application Ser. No. 10/676,265, filed Oct. 2, 2003, now U.S. Pat. No. 8,136,580, issued Mar. 20, 2012, and which is a divisional of U.S. patent application Ser. No. 10/694,387, filed Oct. 28, 2003, now U.S. Pat. No. 7,708,053, issued May 4, 2010, which claims the benefit of U.S. Provisional Patent Application Ser. No. 60/421,737, filed Oct. 28, 2002. This application is also related to U.S. patent application Ser. No. 12/426,001, filed Apr. 17, 2009, now U.S. Pat. No. 8,066,055, issued Nov. 29, 2011, which is a continuation of U.S. patent application Ser. No. 10/890,382, filed Jul. 14, 2004, now U.S. Pat. No. 7,549,461, issued Jun. 23, 2009, which claims the benefit of U.S. Provisional Patent Application Ser. No. 60/486,467, filed Jul. 14, 2003. This application is also related to U.S. patent application Ser. No. 11/383,740, filed May 16, 2006, now U.S. Pat. No. 7,931,072, issued Apr. 26, 2011, which is a continuation-in-part of U.S. patent application Ser. No. 10/676,265, filed Oct. 2, 2003, now U.S. Pat. No. 8,136,580, issued Mar. 20, 2012.

TECHNICAL FIELD

This description relates to evaporators for heat transfer systems.

BACKGROUND

Heat transfer systems are used to transport heat from one location (the heat source) to another location (the heat sink). Heat transfer systems can be used in terrestrial or extraterrestrial applications. For example, heat transfer systems may be integrated by satellite equipment that operates within zero- or low-gravity environments. As another example, heat transfer systems can be used in electronic equipment, which often requires cooling during operation.

Loop Heat Pipes (LHPs) and Capillary Pumped Loops (CPLs) are passive two-phase heat transfer systems. Each includes an evaporator thermally coupled to the heat source, a condenser thermally coupled to the heat sink, fluid that flows between the evaporator and the condenser, and a fluid reservoir for expansion of the fluid. The fluid within the heat transfer system can be referred to as the working fluid. The evaporator includes a primary wick and a core that includes a fluid flow passage. Heat acquired by the evaporator is transported to and discharged by the condenser. These systems utilize capillary pressure developed in a fine-pored wick within the evaporator to promote circulation of working fluid from the evaporator to the condenser and back to the evaporator. The primary distinguishing characteristic between an LHP and a CPL is the location of the loop's reservoir, which is used to store excess fluid displaced from the loop during operation. In general, the reservoir of a CPL is located remotely from the evaporator, while the reservoir of an LHP is co-located with the evaporator.

SUMMARY

In one general aspect, an evaporator for a heat transfer system includes a heated wall, a liquid barrier wall, a primary wick positioned between the heated wall and an inner side of the liquid barrier wall, a vapor removal channel, and a liquid flow channel. The liquid barrier wall contains working fluid on the inner side of the liquid barrier wall. The fluid flows only along the inner side of the liquid barrier wall. The vapor removal channel is located at an interface between the primary wick and the heated wall. The liquid flow channel is located between the liquid barrier wall and the primary wick.

Implementations may include one or more of the following features. For example, the evaporator may further include additional vapor removal channels located at an interface between the primary wick and the heated wall. The evaporator may also include additional liquid flow channels located between the liquid barrier wall and the primary wick.

The primary wick, the heated wall, and the liquid barrier wall may be planar.

The primary wick may have a thermal conductivity that is low enough to reduce leakage of heat from the heated wall, through the primary wick, and toward the liquid barrier wall. The heated wall may be defined so as to accommodate the vapor removal channel. The vapor removal channel may be electro-etched or machined into a heated wall.

The interface at the primary wick may be defined so as to accommodate the vapor removal channel. The vapor removal channel may be electro-etched or machined into the heated wall. The vapor removal channel may be embedded within the primary wick at the interface.

A cross-section of the vapor removal channel may be sufficient to ensure vapor flow generated at the interface between the primary wick and the heated wall without a significant pressure drop. The surface contact between the heated wall and the primary wick may be selected to provide better heat transfer from a heat source at the heated wall into the vapor removal channel. A thickness of the heated wall may be selected to ensure sufficient vaporization at the interface between the primary wick and the heated wall.

The liquid flow channel may supply the primary wick with liquid from a liquid inlet. The liquid flow channel may be configured to supply the primary wick with enough liquid to offset liquid vaporized at the interface between the primary wick and the heated wall and liquid vaporized at the liquid barrier wall.

The number of vapor removal channels may be higher than the number of liquid flow channels.

The evaporator may also include a secondary wick between the vapor removal channel and the primary wick, and a vapor vent channel at an interface between the secondary wick and the primary wick. The vapor bubbles formed within the vapor vent channel may be swept through the secondary wick and through the liquid flow channel. The vapor vent channel may deliver vapor that has vaporized within the primary wick near the liquid barrier wall away from the primary wick. The secondary wick may be a mesh screen or a slab wick.

The heated wall and the liquid barrier wall may be capable of withstanding internal pressure of the working fluid. The primary wick, the heated wall, and the liquid barrier wall may be annular and coaxial, such that the heated wall is inside the primary wick, which is inside the liquid barrier wall.

The vapor removal channel may be thermally segregated from the liquid flow channel. The liquid barrier wall may be equipped with fins that cool a liquid side of the evaporator. The liquid barrier wall may be cooled by passing liquid across an outer surface of the liquid barrier wall.

In another general aspect, a heat transfer system includes an evaporator, a condenser having a vapor inlet and a liquid outlet, a vapor line providing fluid communication between a vapor outlet of the evaporator and the vapor inlet, and a liquid return line providing fluid communication between the liquid outlet and a liquid inlet entering the evaporator. The evaporator includes a heated wall, a liquid barrier wall containing working fluid, a primary wick positioned between the heated wall and the inner side of the liquid barrier wall, a vapor removal channel located at an interface between the primary wick and the heated wall, and a liquid flow channel located between the liquid barrier wall and the primary wick. The working fluid flows only along the inner side of the liquid barrier wall. The vapor removal channels extend to the vapor outlet and the liquid flow channel receives liquid from the liquid inlet.

Implementations may include one or more of the following features. For example, the liquid barrier wall of the evaporator may be equipped with heat exchange fins. The heat transfer system may further include a reservoir in the liquid return line. The evaporator may include a secondary wick between the vapor removal channel and the primary wick, and a vapor vent channel at an interface between the secondary wick and the primary wick.

Vapor bubbles formed within the vapor vent channel may be swept through the secondary wick, through the liquid flow channel, and into the reservoir. The vapor vent channel may deliver vapor that has vaporized within the primary wick near the liquid barrier wall away from the primary wick and into the reservoir. Vapor bubbles may be vented into the reservoir from the evaporator.

The reservoir may be cold biased. The evaporator may be planar.

The evaporator may be annular such that the heated wall is inside the primary wick, which is inside the liquid barrier wall.

The liquid returning into the evaporator from the condenser may be subcooled by the condenser. An amount of subcooling produced by the condenser may balance heat leakage through the primary wick. The heat transfer system may further include a reservoir in the liquid return line. The subcooling may maintain a thermal balance within the reservoir. The liquid return line may enter the evaporator through the reservoir. The reservoir may be formed between the liquid barrier wall and the primary wick of the evaporator, as a separate vessel that communicates with the liquid inlet of the evaporator, or adjacent the liquid barrier wall of the evaporator. The reservoir may be equipped with fins that cool the reservoir.

The temperature difference between the reservoir and the primary wick near the heated wall may ensure circulation of the working fluid through the heat transfer system.

The heated wall may contact a hot side of a Stirling cooling machine.

The liquid flow channel may be fed with liquid from a reservoir located above the primary wick. The liquid barrier wall may be cold biased.

Aspects of the techniques and systems can include one or more of the following advantages.

The evaporator may be used in any two-phase heat transfer system for use in terrestrial or extraterrestrial applications. For example, the heat transfer systems can be used in electronic equipment, which often requires cooling during operation, or in laser diode applications.

The planar evaporator may be used in any heat transfer system in which the heat source is formed as a planar surface. The annular evaporator may be used in any heat transfer system in which the heat source is formed as a cylindrical surface.

The heat transfer system that uses the annular evaporator takes advantage of gravity when used in terrestrial applications, thus making an LHP suitable for mass production. In many cases, terrestrial applications dictate the orientation of the heat acquisition surfaces and the heat sink as well; the annular evaporator utilizes the advantages of the operation in gravity.

A gravity-fed hydro accumulator, as well as its special sizing together with charge amount, are features that can significantly simplify the design and improve LHP reliability. Simplification of the design, less tolerancing of parts and increasing reliability make it possible to mass-produce loop heat pipes at the cost of copper-water heat pipes currently produced in the millions each year for electronics cooling.

Other features and advantages will be apparent from the description, the drawings, and the claims.

DESCRIPTION OF DRAWINGS

Like reference symbols in the various drawings indicate like elements.

DETAILED DESCRIPTION

As discussed above, in a loop heat pipe (LHP), the reservoir is co-located with the evaporator, thus, the reservoir is thermally and hydraulically connected with the reservoir through a heat-pipe-like conduit. In this way, liquid from the reservoir can be pumped to the evaporator, thus ensuring that the primary wick of the evaporator is sufficiently wetted or "primed" during start-up. Additionally, the design of the LHP also reduces depletion of liquid from the primary wick of the evaporator during steady-state or transient operation of the evaporator within a heat transport system. Moreover, vapor and/or bubbles of non-condensable gas (NCG bubbles) vent from a core of the evaporator through the heat-pipe-like conduit into the reservoir.

Conventional LHPs require that liquid be present in the reservoir prior to start-up, that is, application of power to the evaporator of the LHP. However, if the working fluid in the LHP is in a supercritical state prior to start-up of the LHP, liquid will not be present in the reservoir prior to start-up. A supercritical state is a state in which a temperature of the LHP is above the critical temperature of the working fluid. The critical temperature of a fluid is the highest temperature at which the fluid can exhibit a liquid-vapor equilibrium. For example, the LHP may be in a supercritical state if the working fluid is a cryogenic fluid, that is, a fluid having a boiling point below −150° C., or if the working fluid is a sub-ambient fluid, that is, a fluid having a boiling point below the temperature of the environment in which the LHP is operating.

Conventional LHPs also require that liquid returning to the evaporator is subcooled, that is, cooled to a temperature that is lower than the boiling point of the working fluid. Such a constraint makes it impractical to operate LHPs at a sub-ambient temperature. For example, if the working fluid is a cryogenic fluid, the LHP is likely operating in an environment having a temperature greater than the boiling point of the fluid.

Figure 1:
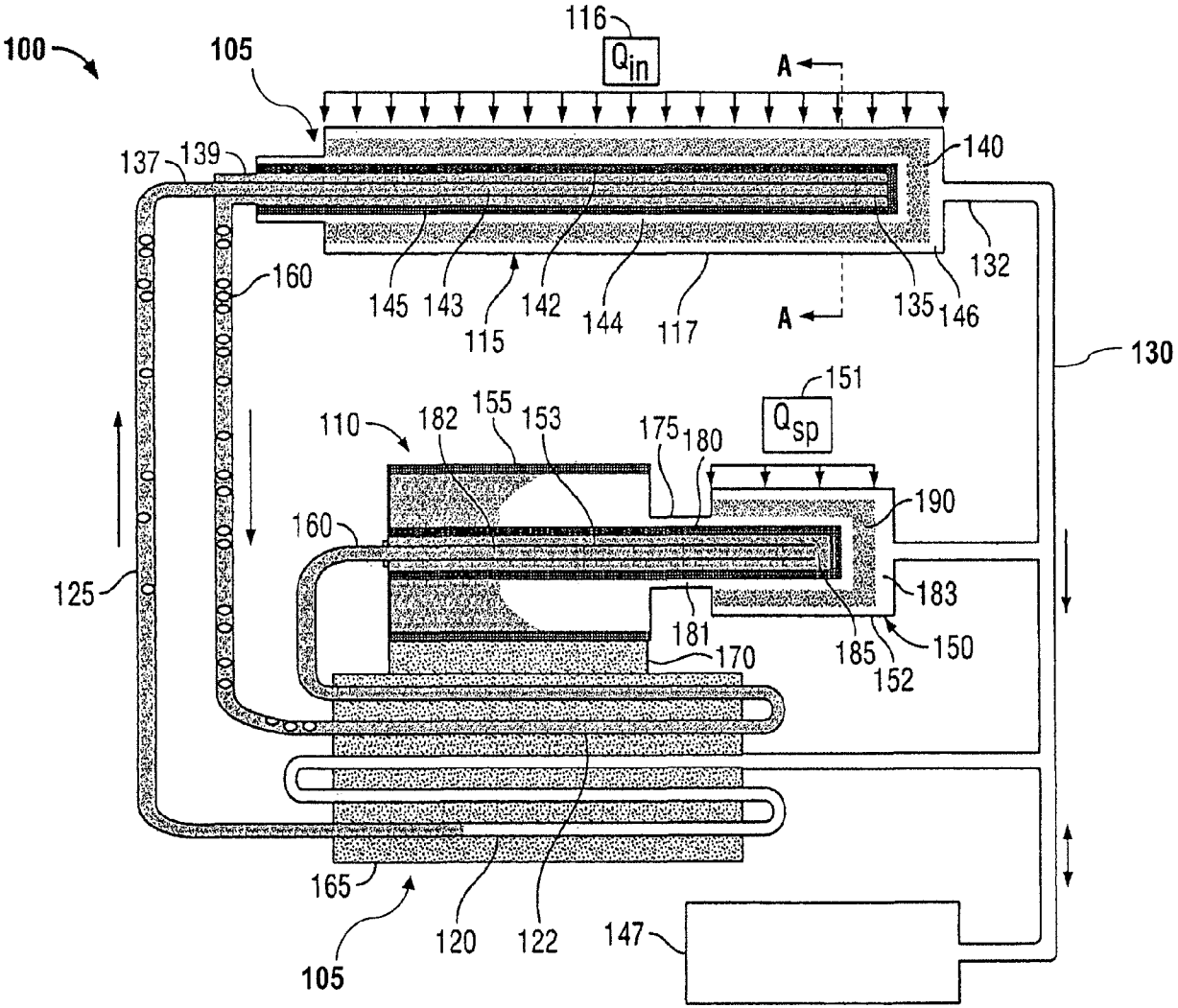
FIG. 1 is a schematic diagram of a heat transport system.

Referring to FIG. 1, a heat transport system 100 is designed to overcome limitations of conventional LHPs. The heat transport system 100 includes a heat transfer system 105 and a priming system 110. The priming system 110 is configured to convert fluid within the heat transfer system 105 into a liquid, thus priming the heat transfer system 105. As used in this description, the term "fluid" is a generic term that refers to a substance that is both a liquid and a vapor in saturated equilibrium.

The heat transfer system 105 includes a main evaporator 115, and a condenser 120 coupled to the main evaporator 115 by a liquid line 125 and a vapor line 130. The condenser 120 is in thermal communication with a heat sink 165, and the main evaporator 115 is in thermal communication with a heat source $Q_{in}$ 116. The heat transfer system 105 may also include a hot reservoir 147 coupled to the vapor line 130 for additional pressure containment, as needed. In particular, the hot reservoir 147 increases the volume of the heat transport system 100. If the working fluid is at a temperature above its critical temperature, that is, the highest temperature at which the working fluid can exhibit liquid-vapor equilibrium, its pressure is proportional to the mass in the heat transport system 100 (the charge) and inversely proportional to the volume of the system. Increasing the volume with the hot reservoir 147 lowers the fill pressure.

The main evaporator 115 includes a container 117 that houses a primary wick 140 within which a core 135 is defined. The main evaporator 115 includes a bayonet tube 142 and a secondary wick 145 within the core 135. The bayonet tube 142, the primary wick 140, and the secondary wick 145 define a liquid passage 143, a first vapor passage 144, and a second vapor passage 146. The secondary wick 145 provides phase control, that is, liquid/vapor separation in the core 135, as discussed in U.S. Pat. No. 6,889,754, issued May 10, 2005, which is incorporated herein by reference in its entirety. As shown, the main evaporator 115 has three ports: a liquid inlet 137 into the liquid passage 143, a vapor outlet 132 into the vapor line 130 from the second vapor passage 146, and a fluid outlet 139 from the liquid passage 143 (and possibly the first vapor passage 144, as discussed below). Further details on the structure of a three-port evaporator are discussed below with respect to FIGS. 5A and 5B.

The priming system 110 includes a secondary or priming evaporator 150 coupled to the vapor line 130 and a reservoir 155 co-located with the secondary evaporator 150. The reservoir 155 is coupled to the core 135 of the main evaporator 115 by a secondary fluid line 160 and a secondary condenser 122. The secondary fluid line 160 couples to the fluid outlet 139 of the main evaporator 115. The priming system 110 also includes a controlled heat source $Q_{sp}$ 151 in thermal communication with the secondary evaporator 150.

The secondary evaporator 150 includes a container 152 that houses a primary wick 190 within which a core 185 is defined. The secondary evaporator 150 includes a bayonet tube 153 and a secondary wick 180 that extend from the core 185, through a conduit 175, and into the reservoir 155. The secondary wick 180 provides a capillary link between the reservoir 155 and the secondary evaporator 150. The bayonet tube 153, the primary wick 190, and the secondary wick 180 define a liquid passage 182 coupled to the fluid line 160, a first vapor passage 181 coupled to the reservoir 155, and a second vapor passage 183 coupled to the vapor line 130. The reservoir 155 is thermally and hydraulically coupled to the core 185 of the secondary evaporator 150 through the liquid passage 182, the secondary wick 180, and the first vapor passage 181. Vapor and/or NCG bubbles from the core 185 of the secondary evaporator 150 are swept through the first vapor passage 181 to the reservoir 155 and condensable liquid is returned to the secondary evaporator 150 through the secondary wick 180 from the reservoir 155. The primary wick 190 hydraulically links liquid within the core 185 to the heat source $Q_{sp}$ 151, permitting liquid at an outer surface of the primary wick 190 to evaporate and form vapor within the second vapor passage 183 when heat is applied to the secondary evaporator 150.

The reservoir 155 is cold-biased, and thus, it is cooled by a cooling source that will allow it to operate, if unheated, at a temperature that is lower than the temperature at which the heat transfer system 105 operates. In one implementation, the reservoir 155 and the secondary condenser 122 are in thermal communication with the heat sink 165 that is thermally coupled to the condenser 120. For example, the reservoir 155 can be mounted to the heat sink 165 using a shunt 170, which may be made of aluminum or any heat-conductive material. In this way, the temperature of the reservoir 155 tracks the temperature of the condenser 120.

Figure 2:
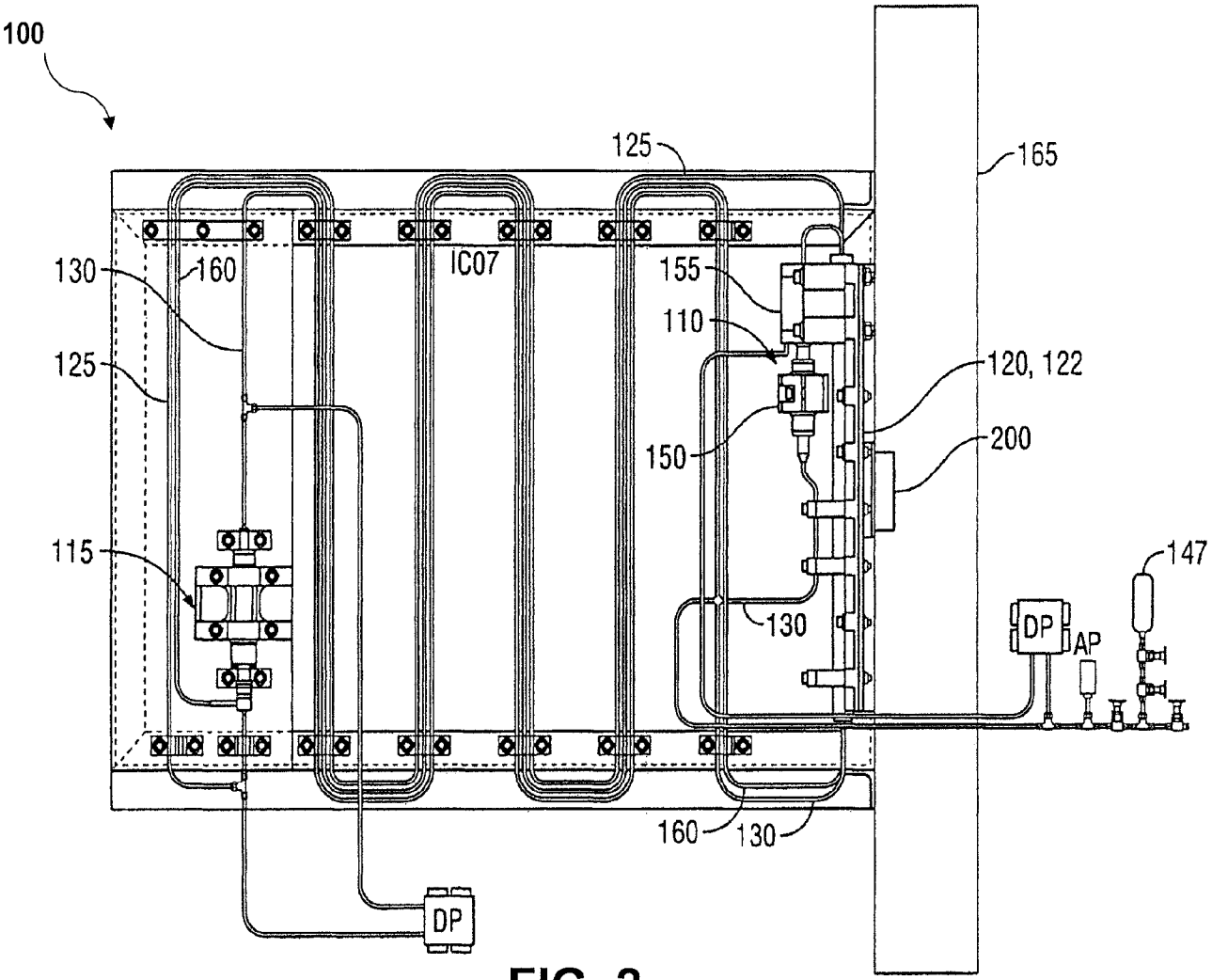
FIG. 2 is a diagram of an implementation of the heat transport system schematically shown by FIG. 1.

FIG. 2 shows an example of an implementation of the heat transport system 100. In this implementation, the condensers 120 and 122 are mounted to a cryocooler 200, which acts as a refrigerator, transferring heat from the condensers 120, 122 to the heat sink 165. Additionally, in the implementation of FIG. 2, the lines 125, 130, 160 are wound to reduce space requirements for the heat transport system 100.

Though not shown in FIGS. 1 and 2, elements such as, for example, the reservoir 155 and the main evaporator 115, may be equipped with temperature sensors that can be used for diagnostic or testing purposes.

Figure 3:
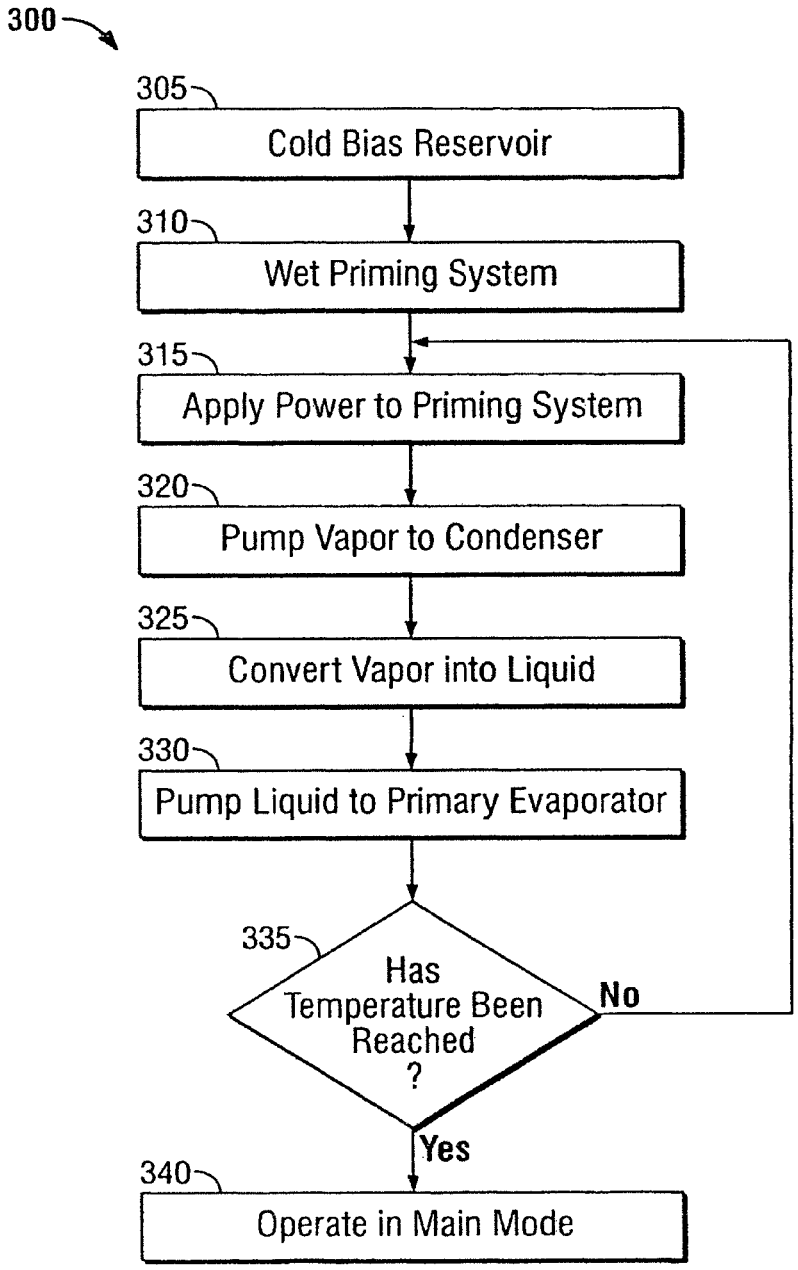
FIG. 3 is a flow chart of a procedure for transporting heat using a heat transport system.

Referring also to FIG. 3, the heat transport system 100 performs a procedure 300 for transporting heat from the heat source $Q_{in}$ 116 and for ensuring that the main evaporator 115 is wetted with liquid prior to startup. The procedure 300 is particularly useful when the heat transfer system 105 is at a supercritical state. Prior to initiation of the procedure 300, the heat transport system 100 is filled with a working fluid at a particular pressure, referred to as a "fill pressure." Initially, the reservoir 155 is cold-biased by, for example, mounting the reservoir 155 to the heat sink 165 (step 305). The reservoir 155 may be cold-biased to a temperature below the critical temperature of the working fluid, which, as discussed, is the highest temperature at which the working fluid can exhibit liquid-vapor equilibrium. For example, if the fluid is ethane, which has a critical temperature of 33° C., the reservoir 155 is cooled to below 33° C. As the temperature of the reservoir 155 drops below the critical temperature of the working fluid, the reservoir 155 partially fills with a liquid condensate formed by the working fluid. The formation of liquid within the reservoir 155 wets the secondary wick 180 and the primary wick 190 of the secondary evaporator 150 (step 310).

Meanwhile, power is applied to the priming system 110 by applying heat from the heat source $Q_{sp}$ 151 to the secondary evaporator 150 (step 315) to enhance or initiate circulation of fluid within the heat transfer system 105. Vapor output by the secondary evaporator 150 is pumped through the vapor line 130 and through the condenser 120 (step 320) due to capillary pressure at the interface between the primary wick 190 and the second vapor passage 183. As vapor reaches the condenser 120, it is converted to liquid (step 325). The liquid formed in the condenser 120 is pumped to the main evaporator 115 of the heat transfer system 105 (step 330). When the main evaporator 115 is at a higher temperature than the critical temperature of the fluid, the liquid entering the main evaporator 115 evaporates and cools the main evaporator 115. This process (steps 315-330) continues, causing the main evaporator 115 to reach a set point temperature (step 335), at which point the main evaporator is able to retain liquid and be wetted and to operate as a capillary pump. In one implementation, the set point temperature is the temperature to which the reservoir 155 has been cooled. In another implementation, the set point temperature is a temperature below the critical temperature of the working fluid. In a further implementation, the set point temperature is a temperature above the temperature to which the reservoir 155 has been cooled.

If the set point temperature has been reached (step 335), the heat transport system 100 operates in a main mode (step 340) in which heat from the heat source $Q_{in}$ 116 that is applied to the main evaporator 115 is transferred by the heat transfer system 105. Specifically, in the main mode, the main evaporator 115 develops capillary pumping to promote circulation of the working fluid through the heat transfer system 105. Also, in the main mode, the set point temperature of the reservoir 155 is reduced. The rate at which the heat transfer system 105 cools down during the main mode depends on the cold biasing of the reservoir 155 because the temperature of the main evaporator 115 closely follows the temperature of the reservoir 155. Additionally, though not required, a heater can be used to further control or regulate the temperature of the reservoir 155 during the main mode. Furthermore, in main mode, the power applied to the secondary evaporator 150 by the heat source $Q_{sp}$ 151 is reduced, thus bringing the heat transfer system 105 down to a normal operating temperature for the fluid. For example, in the main mode, the heat load from the heat source $Q_{sp}$ 151 to the secondary evaporator 150 is kept at a value equal to or in excess of heat conditions, as defined below. In one implementation, the heat load from the heat source $Q_{sp}$ 151 is kept to about 5 to 10% of the heat load applied to the main evaporator 115 from the heat source $Q_{in}$ 116.

In this particular implementation, the main mode is triggered by the determination that the set point temperature has been reached (step 335). In other implementations, the main mode may begin at other times or due to other triggers. For example, the main mode may begin after the priming system is wet (step 310) or after the reservoir has been cold biased (step 305).

At any time during operation, the heat transfer system 105 can experience heat conditions such as those resulting from heat conduction across the primary wick 140 and parasitic heat applied to the liquid line 125. Both conditions cause formation of vapor on the liquid side of the evaporator. Specifically, heat conduction across the primary wick 140 can cause liquid in the core 135 to form vapor bubbles, which, if left within the core 135, would grow and block off liquid supply to the primary wick 140, thus causing the main evaporator 115 to fail. Parasitic heat input into the liquid line 125 (referred to as "parasitic heat gains") can cause liquid within the liquid line 125 to form vapor.

To reduce the adverse impact of heat conditions discussed above, the priming system 110 operates at a power level $Q_{sp}$ 151 greater than or equal to the sum of the heat conduction and the parasitic heat gains. As mentioned above, for example, the priming system can operate at 5-10% of the power to the heat transfer system 105. In particular, fluid that includes a combination of vapor bubbles and liquid is swept out of the core 135 for discharge into the secondary fluid line 160 leading to the secondary condenser 122. In particular, vapor that forms within the core 135 travels around the bayonet tube 142 directly into the fluid outlet 139. Vapor that forms within the first vapor passage 144 makes its way into the fluid outlet 139 by either traveling through the secondary wick 145 (if the pore size of the secondary wick 145 is large enough to accommodate vapor bubbles) or through an opening at an end of the secondary wick 145 near the fluid outlet 139 that provides a clear passage from the first vapor passages 144 to the fluid outlet 139. The secondary condenser 122 condenses the bubbles in the fluid and pushes the fluid to the reservoir 155 for reintroduction into the heat transfer system 105.

Figure 8A:
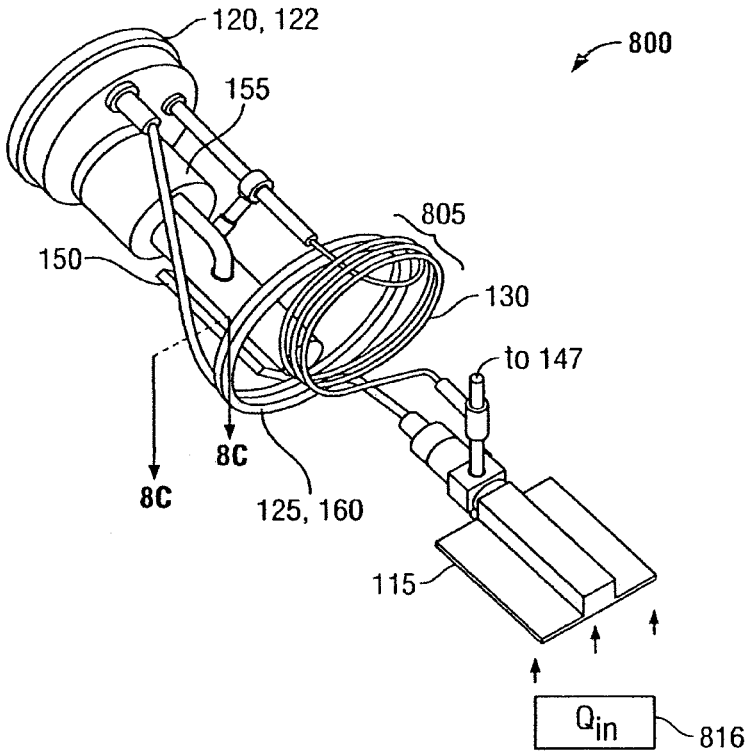
FIGS. 8A, 8B, 9A, and 9B are perspective views of applications using a heat transport system.
Figure 8B:
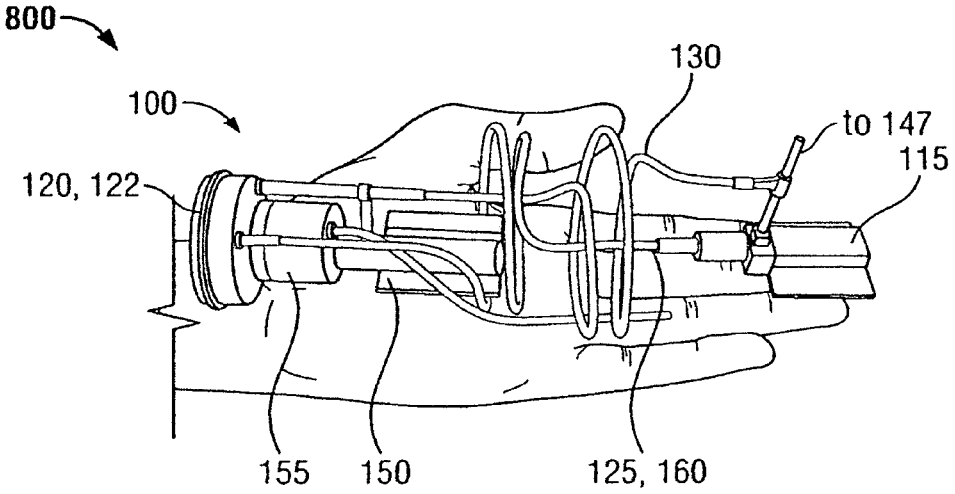
Figure 8C:
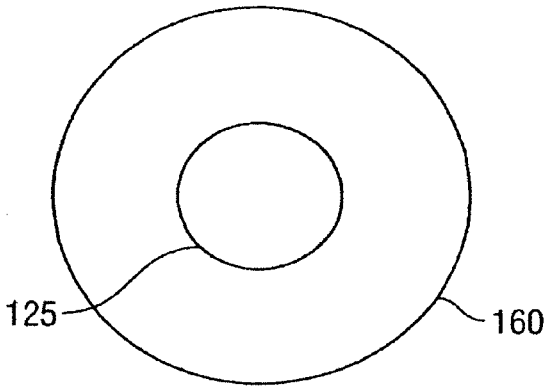
FIG. 8C is a cross-sectional view of a fluid line taken along section line 8C-8C of FIG. 8A.
Figure 8D:
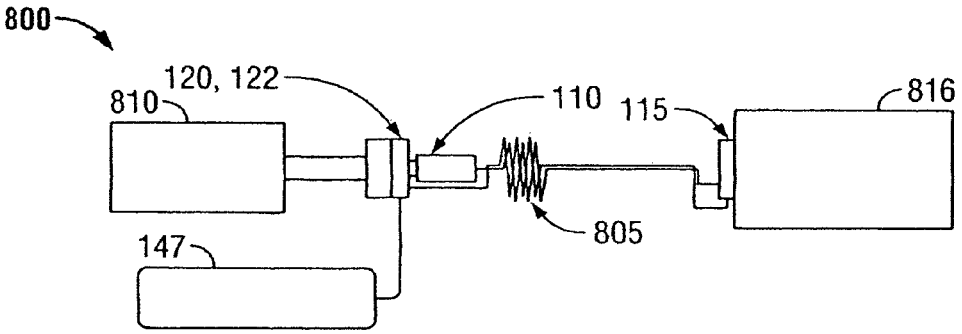
FIGS. 8D and 9C are schematic diagrams of the implementations of the heat transport systems of FIGS. 8A and 9A, respectively.

Similarly, to reduce parasitic heat input to the liquid line 125, the secondary fluid line 160 and the liquid line 125 can form a coaxial configuration and the secondary fluid line 160 surrounds and insulates the liquid line 125 from surrounding heat. This implementation is discussed further below with reference to FIGS. 8A and 8B. As a consequence of this configuration, it is possible for the surrounding heat to cause vapor bubbles to form in the secondary fluid line 160, instead of in the liquid line 125. As discussed, by virtue of capillary action effected at the secondary wick 145, fluid flows from the main evaporator 115 to the secondary condenser 122. This fluid flow, and the relatively low temperature of the secondary condenser 122, causes a sweeping of the vapor bubbles within the secondary fluid line 160 through the condenser 122, where they are condensed into liquid and pumped into the reservoir 155.

Figure 4:
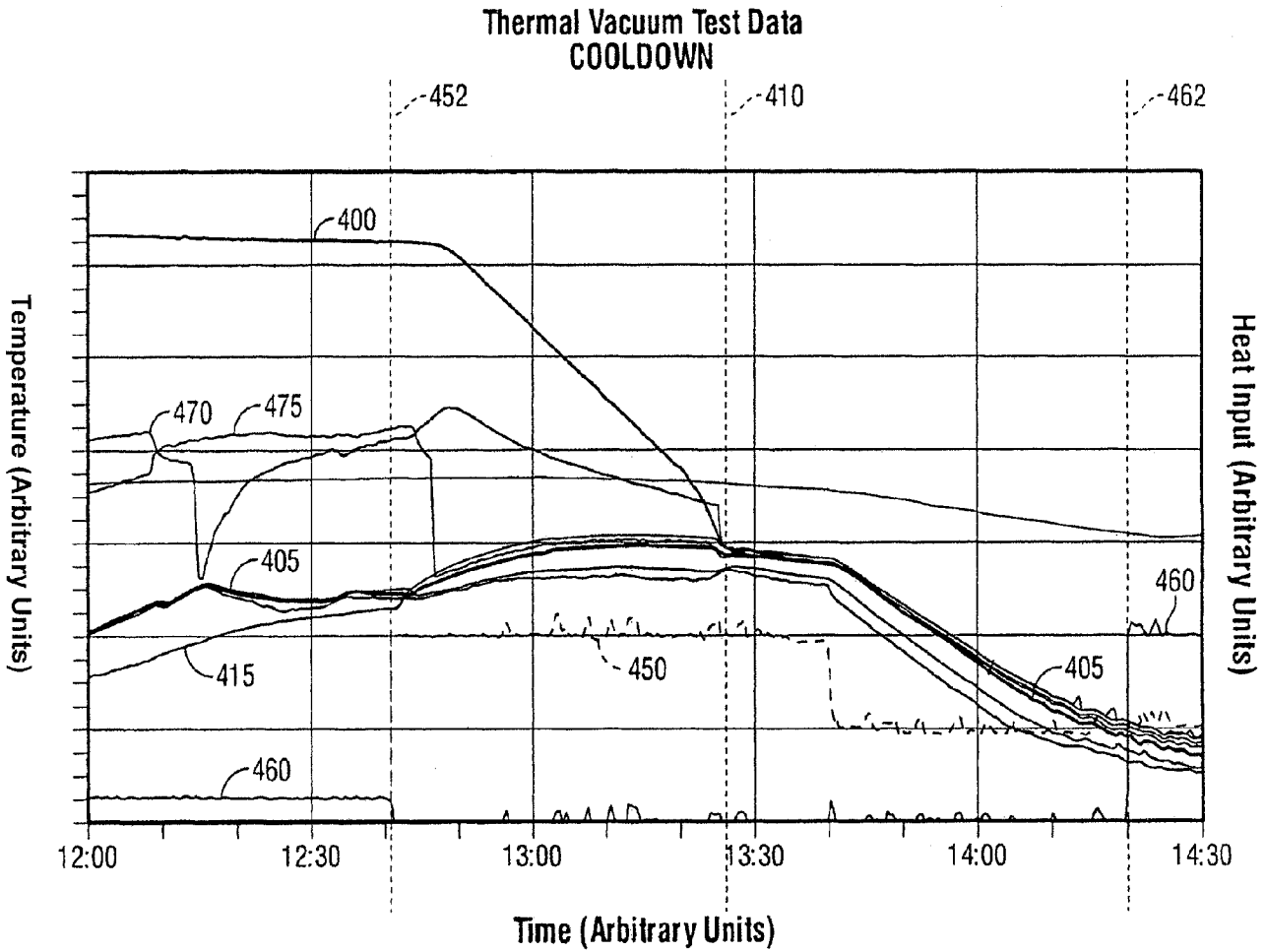
FIG. 4 is a graph showing temperature profiles of various components of the heat transport system during the process flow of FIG. 3.

Data from a test run is shown in FIG. 4. In this implementation, prior to startup of the main evaporator 115 at time 410, a temperature 400 of the main evaporator 115 is significantly higher than a temperature 405 of the reservoir 155, which has been cold-biased to the set point temperature (step 305). As the priming system 110 is wetted (step 310), power $Q_{sp}$ 450 is applied to the secondary evaporator 150 (step 315) at a time 452, causing liquid to be pumped to the main evaporator 115 (step 330), the temperature 400 of the main evaporator 115 drops until it reaches the temperature 405 of the reservoir 155 at time 410. Power input $Q_{in}$ 460 is applied to the main evaporator 115 at a time 462, when the heat transport system 100 is operating in LHP mode (step 340). As shown, power input $Q_{in}$ 460 to the main evaporator 115 is held relatively low while the main evaporator 115 is cooling down. Also shown are the temperatures 470 and 475, respectively, of the secondary fluid line 160 and the liquid line 125. After time 410, temperatures 470 and 475 track the temperature 400 of the main evaporator 115. Moreover, a temperature 415 of the secondary evaporator 150 follows closely with the temperature 405 of the reservoir 155 because of the thermal communication between the secondary evaporator 150 and the reservoir 155.

As mentioned, in one implementation, ethane may be used as the fluid in the heat transfer system 105. Although the critical temperature of ethane is 33° C., for the reasons generally described above, the heat transport system 100 can start up from a supercritical state in which the heat transport system 100 is at a temperature of 70° C. As power $Q_{sp}$ 450 is applied to the secondary evaporator 150, the temperatures of the condenser 120 and the reservoir 155 drop rapidly (between times 452 and 410). A trim heater can be used to control the temperature of the reservoir 155 and thus the condenser 120 to −10° C. To start up the main evaporator 115 from the supercritical temperature of 70° C., a heat load or power input $Q_{sp}$ of 10 W is applied to the secondary evaporator 150. Once the main evaporator 115 is primed, the power input from the heat source $Q_{sp}$ 151 to the secondary evaporator 150 and the power applied to and through the trim heater both may be reduced to bring the temperature of the heat transport system 100 down to a nominal operating temperature of about −50° C. For instance, during the main mode, if a power input $Q_{in}$ 460 of 40 W is applied to the main evaporator 115, the power input $Q_{sp}$ to the secondary evaporator 150 can be reduced to approximately 3 W while operating at −45° C. to mitigate the 3 W lost through heat conditions (as discussed above). As another example, the main evaporator 115 can operate with power input $Q_{in}$ from about 10 W to about 40 W with 5 W applied to the secondary evaporator 150 and with the temperature 405 of the reservoir 155 at approximately −45° C.

Figure 5A:
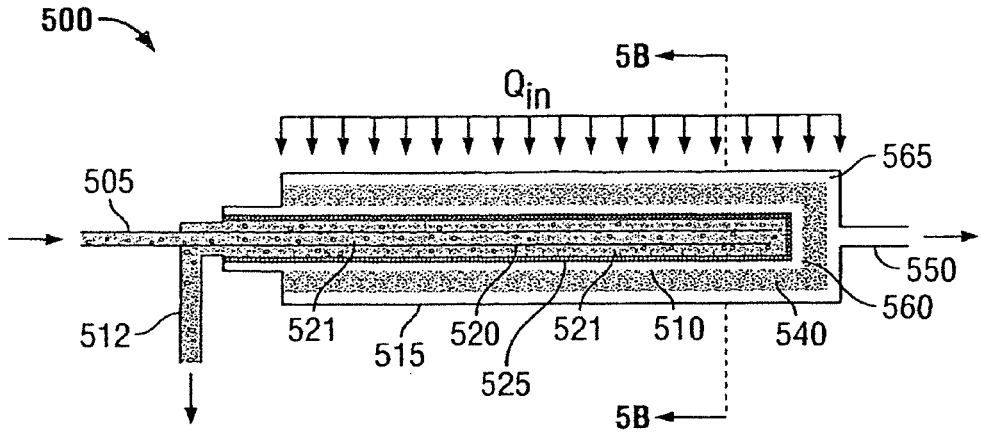
FIG. 5A is a diagram of a three-port main evaporator shown within the heat transport system of FIG. 1.
Figure 5B:
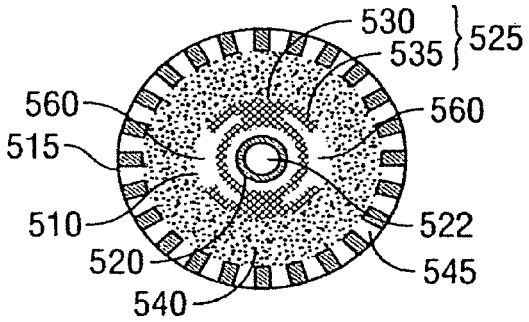
FIG. 5B is a cross-sectional view of the main evaporator taken along section line 5B-5B of FIG. 5A.

Referring to FIGS. 5A and 5B, in one implementation, the main evaporator 115 is designed as a three-port evaporator 500 (which is the design shown in FIG. 1). Generally, in the three-port evaporator 500, liquid flows into a liquid inlet 505 into a core 510, defined by a primary wick 540, and fluid from the core 510 flows from a fluid outlet 512 to a cold-biased reservoir (such as reservoir 155). The fluid and the core 510 are housed within a container 515 made of, for example, aluminum. In particular, fluid flowing from the liquid inlet 505 into the core 510 flows through a bayonet tube 520, into a liquid passage 521 that flows through and around the bayonet tube 520. Fluid can flow through a secondary wick 525 (such as secondary wick 145 of evaporator 115) made of a wick material 530 and an annular artery 535. The wick material 530 separates the annular artery 535 from a first vapor passage 560. As power from the heat source $Q_{in}$ 116 is applied to the evaporator 500, liquid from the core 510 enters the primary wick 540 and evaporates, forming vapor that is free to flow along a second vapor passage 565 that includes one or more vapor grooves 545 and out a vapor outlet 550 into the vapor line 130. Vapor bubbles that form within first vapor passage 560 of the core 510 are swept out of the core 510 through the first vapor passage 560 and into the fluid outlet 512. As discussed above, vapor bubbles within the first vapor passage 560 may pass through the secondary wick 525 if the pore size of the secondary wick 525 is large enough to accommodate the vapor bubbles. Alternatively, or additionally, vapor bubbles within the first vapor passage 560 may pass through an opening of the secondary wick 525 formed at any suitable location along the secondary wick 525 to enter the liquid passage 521 or the fluid outlet 512.

Figure 6:
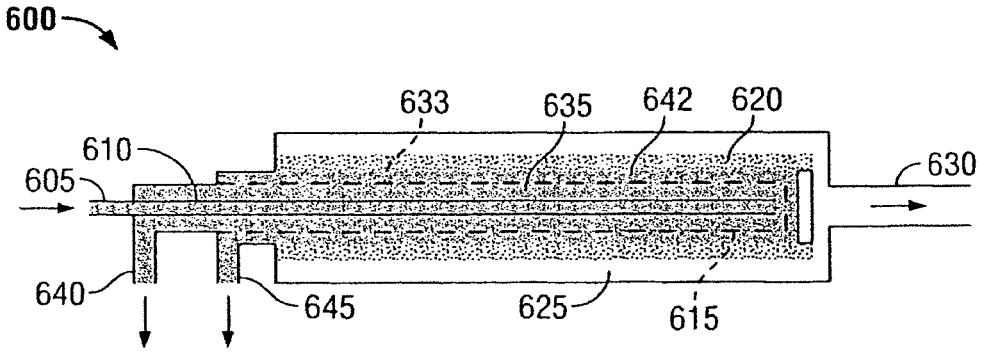
FIG. 6 is a diagram of a four-port main evaporator that can be integrated into a heat transport system illustrated by FIG. 1.

Referring to FIG. 6, in another implementation, the main evaporator 115 is designed as a four-port evaporator 600, which is a design described in U.S. Pat. No. 6,889,754, issued May 10, 2005. Briefly, and with emphasis on aspects that differ from the three-port evaporator configuration, liquid flows into the evaporator 600 through a fluid inlet 605, through a bayonet 610, and into a core 615. The liquid within the core 615 enters a primary wick 620 and evaporates, forming vapor that is free to flow along vapor grooves 625 and out a vapor outlet 630 into the vapor line 130. A secondary wick 633 within the core 615 separates liquid within the core 615 from vapor or bubbles in the core 615 (that are produced when liquid in the core 615 heats). The liquid-carrying bubbles formed within a first fluid passage 635 inside the secondary wick 633 flows out of a fluid outlet 640 and the vapor or bubbles formed within a vapor passage 642 positioned between the secondary wick 633 and the primary wick 620 flow out of a vapor outlet 645.

Figure 7:
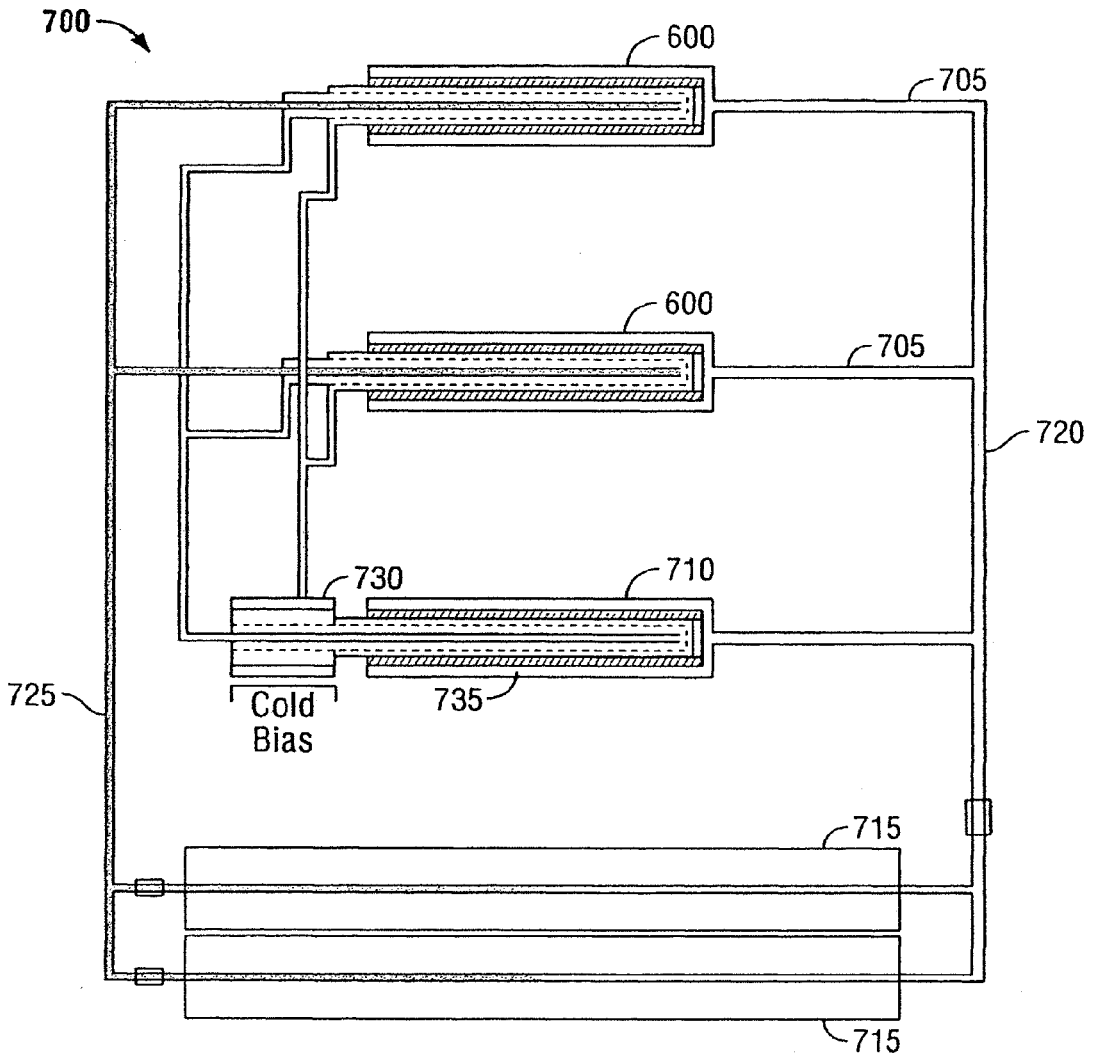
FIG. 7 is a schematic diagram of an implementation of a heat transport system.

Referring also to FIG. 7, a heat transport system 700 is shown in which the main evaporator is a four-port evaporator 600. The system 700 includes one or more heat transfer systems 705 and a priming system 710 configured to convert fluid within the heat transfer systems 705 into a liquid to prime the heat transfer systems 705. The four-port evaporators 600 are coupled to one or more condensers 715 by a vapor line 720 and a fluid line 725. The priming system 710 includes a cold-biased reservoir 730 hydraulically and thermally connected to a priming evaporator 735.

Design considerations of the heat transport system 100 include startup of the main evaporator 115 from a supercritical state, management of parasitic heat leaks, heat conduction across the primary wick 140, cold biasing of the cold reservoir 155, and pressure containment at ambient temperatures that are greater than the critical temperature of the working fluid within the heat transfer system 105. To accommodate these design considerations, the body or container (such as container 515) of the evaporator 115 or 150 can be made of extruded 6063 aluminum and the primary wicks 140 and/or 190 can be made of a fine-pored wick. In one implementation, the outer diameter of the evaporator 115 or 150 is approximately 0.625 inch and the length of the container is approximately 6 inches. The reservoir 155 may be cold-biased to an end panel of the radiator 165 using the aluminum shunt 170. Furthermore, a heater (such as a KAPTON® heater) can be attached at a side of the reservoir 155.

In one implementation, the vapor line 130 is made with smooth-walled stainless steel tubing having an outer diameter (OD) of 3/16 inch and the liquid line 125 and the secondary fluid line 160 are made of smooth-walled stainless steel tubing having an OD of 1/8 inch. The lines 125, 130, 160 may be bent in a serpentine route and plated with gold to minimize parasitic heat gains. Additionally, the lines 125, 130, 160 may be enclosed in a stainless steel box with heaters to simulate a particular environment during testing. The stainless steel box can be insulated with multi-layer insulation (MLI) to minimize heat leaks through panels of the heat sink 165.

In one implementation, the condenser 122 and the secondary fluid line 160 are made of tubing having an OD of 0.25 inch. The tubing is bonded to the panels of the heat sink 165 using, for example, epoxy. Each panel of the heat sink 165 is an 8×19-inch direct condensation, aluminum radiator that uses a 1/16-inch-thick face sheet. KAPTON® heaters can be attached to the panels of the heat sink 165, near the condenser 120 to prevent inadvertent freezing of the working fluid. During operation, temperature sensors, such as thermocouples, can be used to monitor temperatures throughout the heat transport system 100.

The heat transport system 100 may be implemented in any circumstances where the critical temperature of the working fluid of the heat transfer system 105 is below the ambient temperature at which the heat transport system 100 is operating. The heat transport system 100 can be used to cool down components that require cryogenic cooling.

Referring to FIGS. 8A-8D, the heat transport system 100 may be implemented in a miniaturized cryogenic system 800. In the miniaturized system 800, the lines 125, 130, 160 are made of flexible material to permit coil configurations 805, which save space. The miniaturized system 800 can operate at −238° C. using neon fluid. Power input $Q_{in}$ 116 is approximately 0.3 W to 2.5 W. The miniaturized system 800 thermally couples a cryogenic component (or heat source that requires cryogenic cooling) 816 to a cryogenic cooling source, such as a cryocooler 810, coupled to cool the condensers 120, 122.

The miniaturized system 800 reduces mass, increases flexibility, and provides thermal switching capability when compared with traditional thermally switchable, vibration-isolated systems. Traditional thermally switchable, vibration-isolated systems require two flexible conductive links (FCLs), a cryogenic thermal switch (CTSW), and a conduction bar (CB) that form a loop to transfer heat from the cryogenic component to the cryogenic cooling source. In the miniaturized system 800, thermal performance is enhanced because the number of mechanical interfaces is reduced. Heat conditions at mechanical interfaces account for a large percentage of heat gains within traditional thermally switchable, vibration-isolated systems. The CB and two FCLs are replaced with the low-mass, flexible, thin-walled tubing used for the coil configurations 805 of the miniaturized system 800.

Moreover, the miniaturized system 800 can function over a wide range of heat transport distances, which permits a configuration in which the cooling source (such as the cryocooler 810) is located remotely from the cryogenic component 816. The coil configurations 805 have a low mass and low surface area, thus reducing parasitic heat gains through the lines 125 and 160. The configuration of the cooling source 810 within miniaturized system 800 facilitates integration and packaging of the system 800 and reduces vibrations on the cooling source 810, which becomes particularly important in infrared sensor applications. In one implementation, the miniaturized system 800 was tested using neon, operating at 25K to 40K.

Figure 9A:
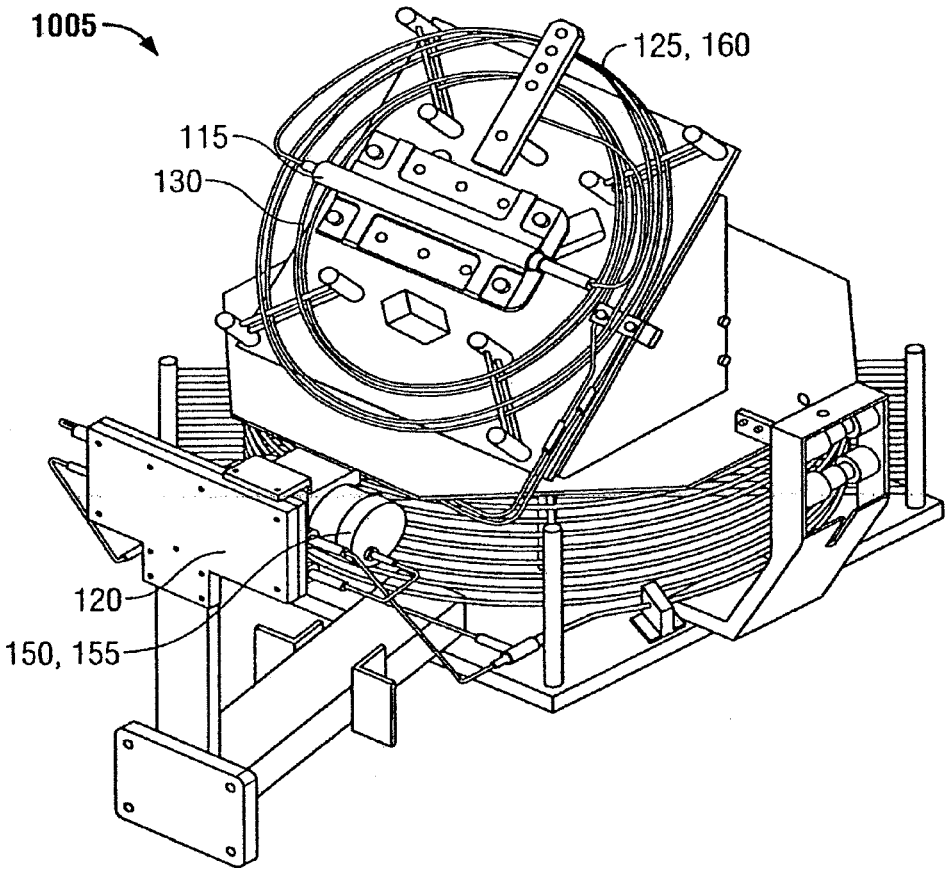
Figure 9B:
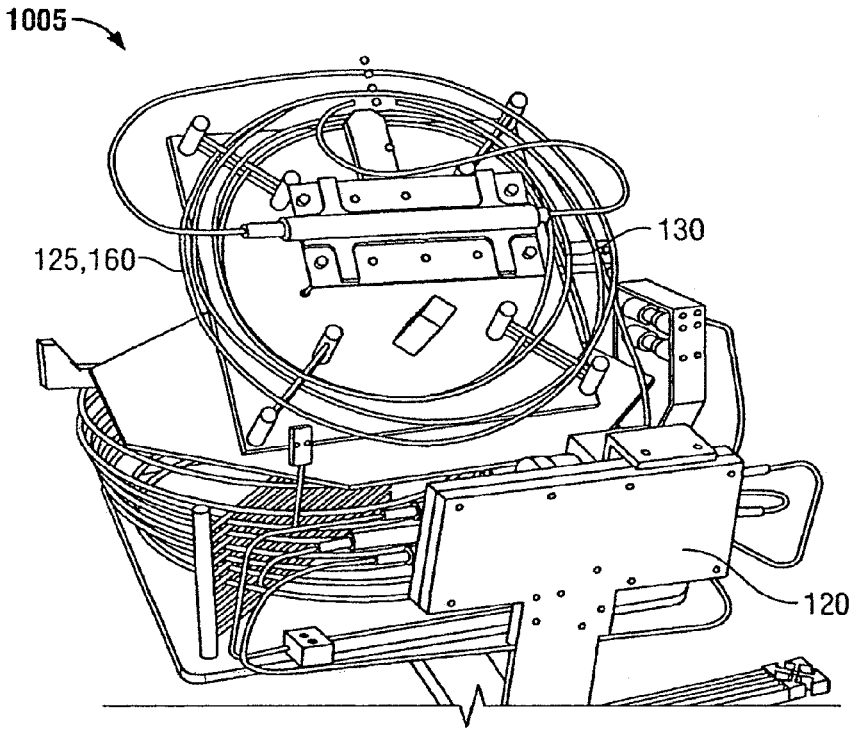
Figure 9C:
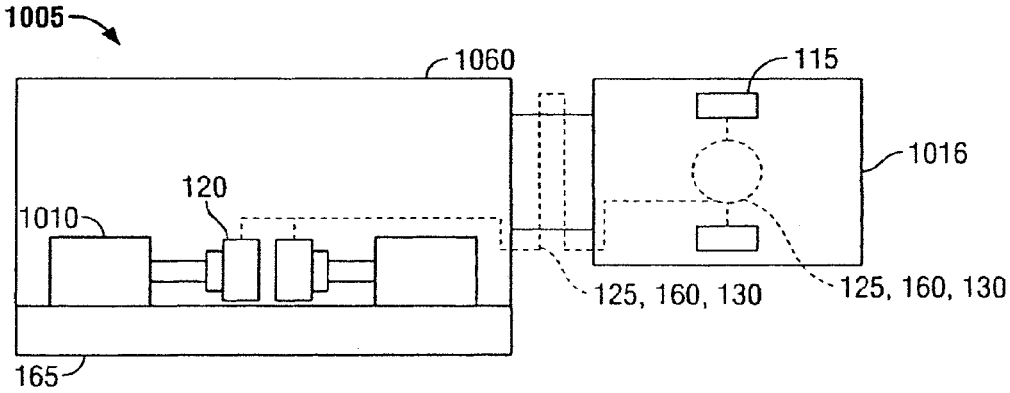

Referring to FIGS. 9A-9C, the heat transport system 100 may be implemented in an adjustable mounted or Gimbaled system 1005 in which the main evaporator 115 and a portion of the lines 125, 160, and 130 are mounted to rotate about an elevation axis within a range of ±45° and a portion of the lines 125, 160, and 130 are mounted to rotate about an azimuth axis (not shown) within a range of ±220°. The lines 125, 160, 130 are formed from thin-walled tubing and are coiled around each axis of rotation. The system 1005 thermally couples a cryogenic component (or heat source that requires cryogenic cooling), such as a sensor 1016 of a cryogenic telescope, to a cryogenic cooling source, such as a cryocooler 1010, coupled to cool the condensers 120, 122. The cooling source 1010 is located at a stationary spacecraft 1060, thus reducing mass at the cryogenic telescope. Motor torque for controlling rotation of the lines 125, 160, 130, power requirements of the system 1005, control requirements for the spacecraft 1060, and pointing accuracy for the sensor 1016 are improved. The cryocooler 1010 and the radiator or heat sink 165 can be moved from the sensor 1016, reducing vibration within the sensor 1016. In one implementation, the system 1005 was tested to operate within the range of 70K to 115K when the working fluid is nitrogen.

The heat transfer system 105 may be used in medical applications or in applications where equipment must be cooled to below-ambient temperatures. As another example, the heat transfer system 105 may be used to cool an infrared (IR) sensor, which operates at cryogenic temperatures to reduce ambient noise. The heat transfer system 105 may be used to cool a vending machine, which often houses items that preferably are chilled to sub-ambient temperatures. The heat transfer system 105 may be used to cool components, such as a display, or a hard drive of a computer, such as a laptop computer, handheld computer, or a desktop computer. The heat transfer system 105 can be used to cool one or more components in a transportation device, such as an automobile or an airplane.

Other implementations are within the scope of the following claims. For example, the condenser 120 and heat sink 165 can be designed as an integral system, such as, for example, a radiator. Similarly, the secondary condenser 122 and heat sink 165 can be formed from a radiator. The heat sink 165 can be a passive heat sink (such as a radiator) or a cryocooler that actively cools the condensers 120, 122.

In another implementation, the temperature of the reservoir 155 is controlled using a heater. In a further implementation, the reservoir 155 is heated using parasitic heat.

In another implementation, a coaxial ring of insulation is formed and placed between the liquid line 125 and the secondary fluid line 160, which surrounds the insulation ring.

Evaporator Design

Evaporators are integral components in two-phase heat transfer systems. For example, as shown above in FIGS. 5A and 5B, the evaporator 500 includes an evaporator body or container 515 that is in contact with the primary wick 540 that surrounds the core 510. The core 510 defines a flow passage 522 for the working fluid. The primary wick 540 is surrounded at its periphery by a plurality of peripheral flow channels or vapor grooves 545. The channels 545 collect vapor at the interface between the wick 540 and the evaporator body 515. The channels 545 are in contact with the vapor outlet 550 that feeds into the vapor line 130 that feeds into the condenser 120 to enable evacuation of the vapor formed within the evaporator 115.

The evaporator 500 and the other evaporators discussed above often have a cylindrical geometry, that is, the core of the evaporator forms a cylindrical passage through which the working fluid passes. The cylindrical geometry of the evaporator is useful for cooling applications in which the heat acquisition surface is cylindrically hollow. Many cooling applications require that heat be transferred away from a heat source having a flat surface. In these sorts of applications, the evaporator can be modified to include a flat conductive saddle to match the footprint of the heat source having the flat surface. Such a design is shown, for example, in U.S. Pat. No. 6,382,309.

The cylindrical geometry of the evaporator facilitates compliance with thermodynamic constraints of LHP operation (that is, the minimization of heat leaks into the reservoir). The constraints of LHP operation stem from the amount of subcooling an LHP needs to produce for normal equilibrium operation. Additionally, the cylindrical geometry of the evaporator is relatively easy to fabricate, handle, machine, and process.

However, as will be described hereinafter, an evaporator can be designed with a planar form to more naturally attach to a flat heat source.

Planar Design

Figure 10:
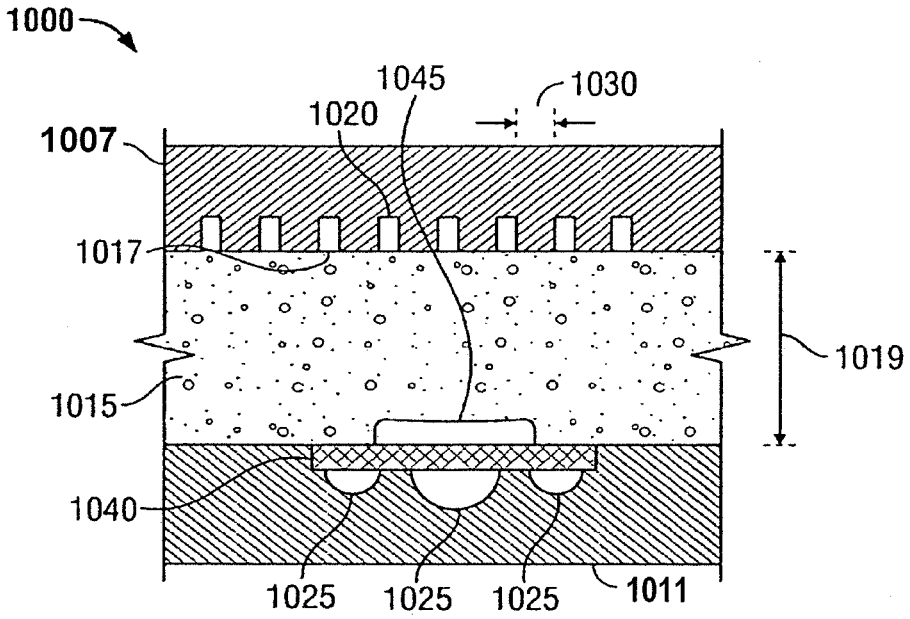
FIG. 10 is a cross-sectional view of a planar evaporator.

Referring to FIG. 10, an evaporator 1000 for a heat transfer system includes a heated wall 1007, a liquid barrier wall 1011, a primary wick 1015 between the heated wall 1007 and an inner side of the liquid barrier wall 1011, vapor removal channels 1020, and liquid flow channels 1025.

The heated wall 1007 is in intimate contact with the primary wick 1015. The liquid barrier wall 1011 contains working fluid on the inner side of the liquid barrier wall 1011, such that the working fluid flows only along the inner side of the liquid barrier wall 1011. The liquid barrier wall 1011 closes the evaporator's envelope and helps to organize and distribute the working fluid through the liquid flow channels 1025. The vapor removal channels 1020 are located at an interface between a vaporization surface 1017 of the primary wick 1015 and the heated wall 1007. The liquid flow channels 1025 are located between the liquid barrier wall 1011 and the primary wick 1015.

The heated wall 1007 acts as a heat acquisition surface for a heat source. The heated wall 1007 is made from a heat-conductive material, such as, for example, sheet metal. Material chosen for the heated wall 1007 typically is able to withstand internal pressure of the working fluid.

The vapor removal channels 1020 are designed to balance the hydraulic resistance of the channels 1020 with the heat conduction through the heated wall 1007 into the primary wick 1015. The channels 1020 can be electro-etched, machined, or formed in a surface with any other convenient method.

The vapor removal channels 1020 are shown as grooves in the inner side of the heated wall 1007. However, the vapor removal channels 1020 can be designed and located in several different ways, depending on the design approach chosen. For example, according to other implementations, the vapor removal channels 1020 are grooved into the outer surface of the primary wick 1015 or embedded into the primary wick 1015, such that they are under the surface of the primary wick 1015. The design of the vapor removal channels 1020 is selected to increase the ease and convenience of manufacturing and to closely approximate one or more of the following guidelines.

First, the hydraulic diameter of the vapor removal channels 1020 should be sufficient to handle a vapor flow generated on the vaporization surface 1017 of the primary wick 1015 without a significant pressure drop. Second, the surface of contact between the heated wall 1007 and the primary wick 1015 should be maximized to provide efficient heat transfer from the heat source to vaporization surface 1017 of the primary wick 1015. Third, a thickness 1030 of the heated wall 1007, which is in contact with the primary wick 1015, should be minimized. As the thickness 1030 increases, vaporization at the surface 1017 of the primary wick 1015 is reduced and transport of vapor through the vapor removal channels 1020 is reduced.

The evaporator 1000 can be assembled from separate parts. Alternatively, the evaporator 1000 can be made as a single part by in-situ sintering of the primary wick 1015 between two walls having special mandrels to form channels on both sides of the wick 1015.

The primary wick 1015 provides the vaporization surface 1017 and pumps or feeds the working fluid from the liquid flow channels 1025 to the vaporization surface 1017 of the primary wick 1015.

The size and design of the primary wick 1015 involves several considerations. The thermal conductivity of the primary wick 1015 should be low enough to reduce heat leak from the vaporization surface 1017, through the primary wick 1015, and to the liquid flow channels 1025. Heat leakage can also be affected by the linear dimensions of the primary wick 1015. For this reason, the linear dimensions of the primary wick 1015 should be properly optimized to reduce heat leakage. For example, an increase in a thickness 1019 of the primary wick 1015 can reduce heat leakage. However, increased thickness 1019 can increase hydraulic resistance of the primary wick 1015 to the flow of the working fluid. In working LHP designs, hydraulic resistance of the working fluid due to the primary wick 1015 can be significant and a proper balancing of these factors is important.

The force that drives or pumps the working fluid of a heat transfer system is a temperature or pressure difference between the vapor and liquid sides of the primary wick. The pressure difference is supported by the primary wick and it is maintained by proper management of the incoming working fluid thermal balance.

The liquid returning to the evaporator from the condenser passes through a liquid return line and is slightly subcooled. The degree of subcooling offsets the heat leak through the primary wick and the heat leak from the ambient into the reservoir within the liquid return line. The subcooling of the liquid maintains a thermal balance of the reservoir. However, there exist other useful methods to maintain thermal balance of the reservoir.

One method is an organized heat exchange between the reservoir and the environment. For evaporators having a planar design, such as those often used for terrestrial applications, the heat transfer system includes heat exchange fins on the reservoir and/or on the liquid barrier wall 1011 of the evaporator 1000. The forces of natural convection on these fins provide subcooling and reduce stress on the condenser and the reservoir of the heat transfer system.

The temperature of the reservoir or the temperature difference between the reservoir and the vaporization surface 1017 of the primary wick 1015 supports the circulation of the working fluid through the heat transfer system. Some heat transfer systems may require an additional amount of subcooling. The required amount may be greater than what the condenser can produce, even if the condenser is completely blocked.

In designing the evaporator 1000, three variables need to be managed. First, the organization and design of the liquid flow channels 1025 need to be determined. Second, the venting of the vapor from the liquid flow channels 1025 needs to be accounted for. Third, the evaporator 1000 should be designed to ensure that liquid fills the liquid flow channels 1025. These three variables are interrelated and thus should be considered and optimized together to form an effective heat transfer system.

As mentioned, it is important to obtain a proper balance between the heat leak into the liquid side of the evaporator and the pumping capabilities of the primary wick. This balancing process cannot be done independently from the optimization of the condenser, which provides subcooling, because the greater heat leak allowed in the design of the evaporator, the more subcooling needs to be produced in the condenser. The longer the condenser, the greater are the hydraulic losses in fluid lines, which may require different wick material with better pumping capabilities.

In operation, as power from a heat source is applied to the evaporator 1000, liquid from the liquid flow channels 1025 enters the primary wick 1015 and evaporates, forming vapor that is free to flow along the vapor removal channels 1020. Liquid flow into the evaporator 1000 is provided by the liquid flow channels 1025. The liquid flow channels 1025 supply the primary wick 1015 with enough liquid to replace liquid that is vaporized on the vapor side of the primary wick 1015 and to replace liquid that is vaporized on the liquid side of the primary wick 1015.

The evaporator 1000 may include a secondary wick 1040, which provides phase management on a liquid side of the evaporator 1000 and supports feeding of the primary wick 1015 in critical modes of operation (as discussed above). The secondary wick 1040 is formed between the liquid flow channels 1025 and the primary wick 1015. The secondary wick can be a mesh screen (as shown in FIG. 10), or an advanced and complicated artery, or a slab wick structure. Additionally, the evaporator 1000 may include a vapor vent channel 1045 at an interface between the primary wick 1015 and the secondary wick 1040.

Heat conduction through the primary wick 1015 may initiate vaporization of the working fluid in the wrong place—on a liquid side of the evaporator 1000 near or within the liquid flow channels 1025. The vapor vent channel 1045 delivers the unwanted vapor away from the wick 1015 into the two-phase reservoir.

The fine pore structure of the primary wick 1015 can create a significant flow resistance for the liquid. Therefore, it is important to optimize the number, the geometry, and the design of the liquid flow channels 1025. The goal of this optimization is to support a uniform, or close to uniform, feeding flow to the vaporization surface 1017. Moreover, as the thickness 1019 of the primary wick 1015 is reduced, the liquid flow channels 1025 can be spaced farther apart.

The evaporator 1000 may require significant vapor pressure to operate with a particular working fluid within the evaporator 1000. Use of a working fluid with a high vapor pressure can cause several problems with pressure containment of the evaporator envelope. Traditional solutions to the pressure containment problem, such as thickening the walls of the evaporator, are not always effective. For example, in planar evaporators having a significant flat area, the walls become so thick that the temperature difference is increased and the evaporator heat conductance is degraded. Additionally, even microscopic deflection of the walls due to the pressure containment results in a loss of contact between the walls and the primary wick. Such a loss of contact impacts heat transfer through the evaporator and microscopic deflection of the walls creates difficulties with the interfaces between the evaporator and the heat source and any external cooling equipment.

Annular Design

Figure 11:
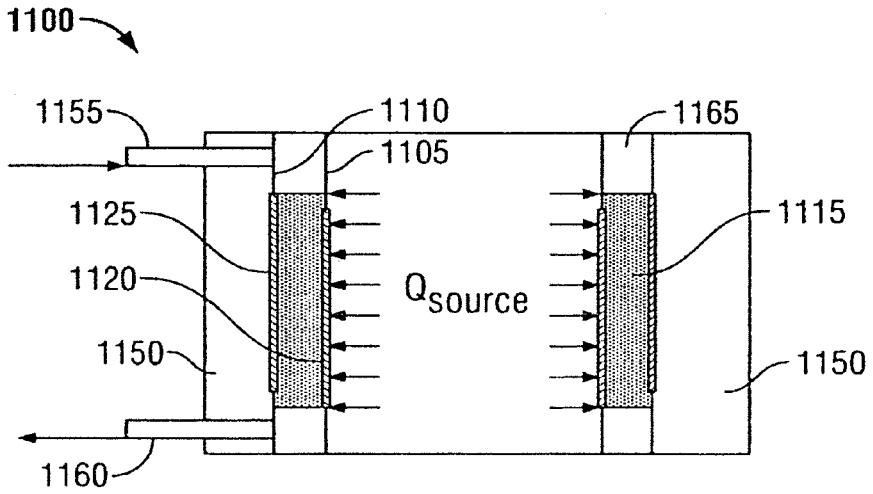
FIG. 11 is an axial cross-sectional view of an annular evaporator.
Figure 12A:
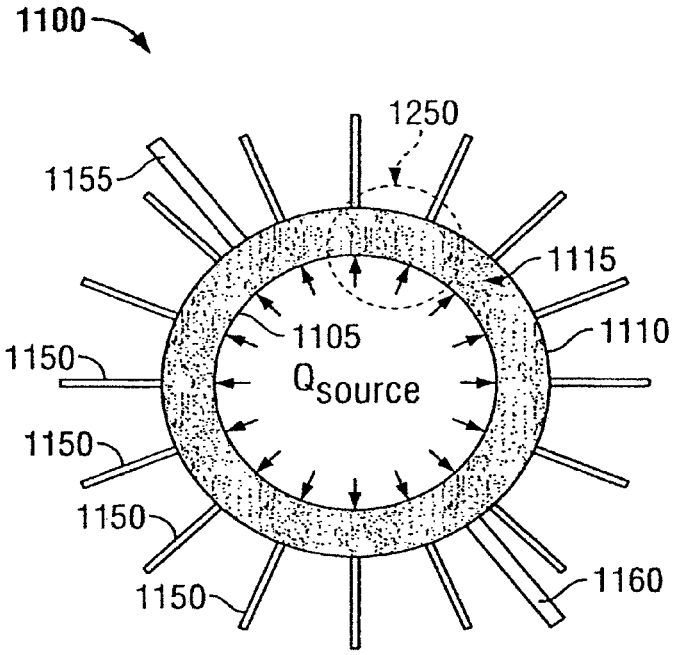
FIG. 12A is a radial cross-sectional view of the annular evaporator of FIG. 11.
Figure 12B:
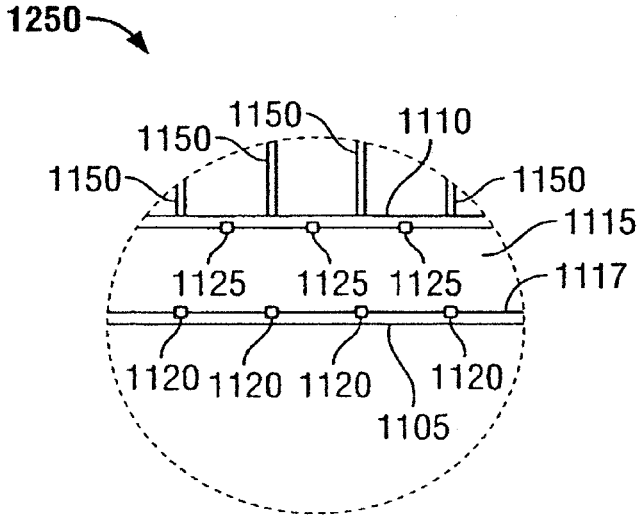
FIG. 12B is an enlarged view of a portion of the radial cross-sectional view of the annular evaporator of FIG. 12A.

Referring to FIGS. 11, 12A, and 12B, an annular evaporator 1100 is formed by effectively rolling the planar evaporator 1000, such that the primary wick 1015 loops back into itself and forms an annular shape. The evaporator 1100 can be used in applications in which the heat sources have a cylindrical exterior profile, or in applications where the heat source can be shaped as a cylinder. The annular shape combines the strength of a cylinder for pressure containment and the curved interface surface for best possible contact with the cylindrically shaped heat sources.

The evaporator 1100 includes a heated wall 1105, a liquid barrier wall 1110, a primary wick 1115 positioned between the heated wall 1105 and the inner side of the liquid barrier wall 1110, vapor removal channels 1120, and liquid flow channels 1125. The liquid barrier wall 1110 is coaxial with the primary wick 1115 and the heated wall 1105.

The heated wall 1105 is in intimate contact with the primary wick 1115. The liquid barrier wall 1110 contains working fluid on an inner side of the liquid barrier wall 1110 such that the working fluid flows only along the inner side of the liquid barrier wall 1110. The liquid barrier wall 1110 closes the evaporator's envelope and helps to organize and distribute the working fluid through the liquid flow channels 1125.

The vapor removal channels 1120 are located at an interface between a vaporization surface 1117 of the primary wick 1115 and the heated wall 1105. The liquid flow channels 1125 are located between the liquid barrier wall 1110 and the primary wick 1115. The heated wall 1105 acts as a heat acquisition surface and the vapor generated on this surface is removed by the vapor removal channels 1120.

The primary wick 1115 fills the volume between the heated wall 1105 and the liquid barrier wall 1110 of the evaporator 1100 to provide reliable reverse menisci vaporization.

The evaporator 1100 can also be equipped with heat exchange fins 1150 that contact the liquid barrier wall 1110 to cold bias the liquid barrier wall 1110. The liquid flow channels 1125 receive liquid from a liquid inlet 1155 and the vapor removal channels 1120 extend to and provide vapor to a vapor outlet 1160.

The evaporator 1100 can be used in a heat transfer system that includes an annular reservoir 1165 adjacent the primary wick 1115. The reservoir 1165 may be cold biased with the heat exchange fins 1150, which extend across the reservoir 1165. The cold biasing of the reservoir 1165 permits utilization of the entire condenser area without the need to generate subcooling at the condenser. The excessive cooling provided by cold biasing the reservoir 1165 and the evaporator 1100 compensates the parasitic heat leaks through the primary wick 1115 into the liquid side of the evaporator 1100.

In another implementation, the evaporator design can be inverted and vaporization features can be placed on an outer perimeter and the liquid return features can be placed on the inner perimeter.

The annular shape of the evaporator 1100 provides several advantages. First, pressure containment is not a problem in the annular evaporator 1100. Second, the primary wick 1115 does not need to be sintered inside, thus providing more space for a more sophisticated design of the vapor and liquid sides of the primary wick 1115.

Many terrestrial applications can incorporate an LHP with an annular evaporator 1100. The orientation of the annular evaporator in a gravity field is predetermined by the nature of application and the shape of the hot surface.

Figure 13:
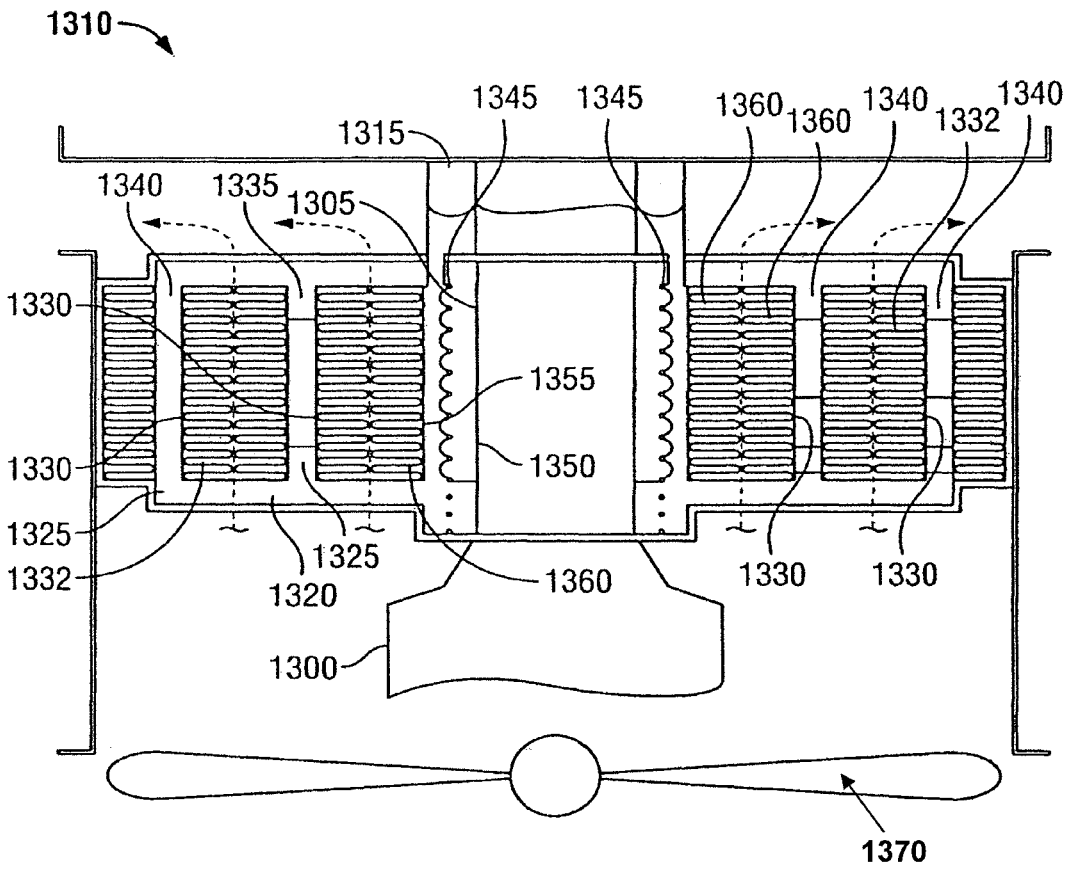
FIG. 13 is a schematic diagram of a heat transfer system using an evaporator designed in accordance with the principles of FIGS. 10-12B.

Referring also to FIG. 13, an annular evaporator 1305 may be used to cool a hot side 1300 of a Stirling cooling machine. The gravity field permits simplification of the liquid supply system and avoids complications related to arrangement of the secondary wick. The annular evaporator 1305 is a part of a heat transfer system 1310 that includes an expansion volume (or reservoir) 1315, a liquid return line 1320 providing fluid communication between liquid outlets 1325 of a condenser 1330 and the liquid inlet of the evaporator 1305. The heat transfer system 1310 includes a vapor line 1335 providing fluid communication between the vapor outlet of the evaporator 1305 and vapor inlets 1340 of the condenser 1330.

The condenser 1330 is constructed from smooth-wall tubing and is equipped with heat exchange fins 1332 or fin stock to intensify heat exchange on the outside of the tubing.

The evaporator 1305 includes a primary wick 1345 sandwiched between a heated wall 1350 and a liquid barrier wall 1355. The liquid barrier wall 1355 is cold biased by heat exchange fins 1360 formed along the outer surface of the wall 1355. The heat exchange fins 1360 provide adequate subcooling for the reservoir 1315 and the entire liquid side of the evaporator 1305. The heat exchange fins 1360 of the evaporator 1305 may be designed separately from the heat exchange fins 1332 of the condenser 1330.

The liquid return line 1320 extends into the reservoir 1315 located above the primary wick 1345, and vapor bubbles, if any, from the liquid return line 1320 and the vapor removal channels at the interface of the primary wick 1345 and the heated wall 1350 are vented into the reservoir 1315.

The evaporator 1305 is attached to the hot side 1300 of the Stirling engine or any other heat-rejecting device. This attachment can be integral, in that the evaporator 1305 can be an integral part of the engine, or the attachment can be non-integral, in that the evaporator 1305 can be clamped to an outer surface of the hot side 1300. The heat transfer system 1310 is cooled by a forced convection sink, which can be provided by a simple fan 1370.

Initially, the liquid phase of the working fluid is collected in a lower part of the evaporator 1305, the liquid return line 1320, and the condenser 1330. The primary wick 1345 is wet because of the capillary forces. As soon as heat is applied (that is, the Stirling engine is turned on), the primary wick 1345 begins to generate vapor, which travels through the vapor removal channels (similar to vapor removal channels 1120 of evaporator 1100) of the evaporator 1305, through the vapor outlet of the evaporator 1305, and into the vapor line 1335.

The vapor then enters the condenser 1330 at an upper part of the condenser 1330. The condenser condenses the vapor into liquid and the liquid is collected at a lower part of the condenser 1330. The liquid is pushed into the reservoir 1315 because of the pressure difference between the reservoir 1315 and the lower part of the condenser 1330. Liquid from the reservoir 1315 enters liquid flow channels of the evaporator 1305. The liquid flow channels of the evaporator 1305 are configured like the channels 1125 of the evaporator 1100 and are properly sized and located to provide adequate liquid replacement for the liquid that vaporized. Capillary pressure created by the primary wick 1345 is sufficient to withstand the overall LHP pressure drop and to prevent vapor bubbles to travel through the primary wick 1345 toward the liquid flow channels.

The liquid flow channels of the evaporator 1305 can be replaced by a simple annulus, if the cold biasing discussed above is sufficient to compensate the increased heat leak across the primary wick 1345, which is caused by the increase in surface area of the heat exchange surface of the annulus versus the surface area of the liquid flow channels.

Figure 14A:
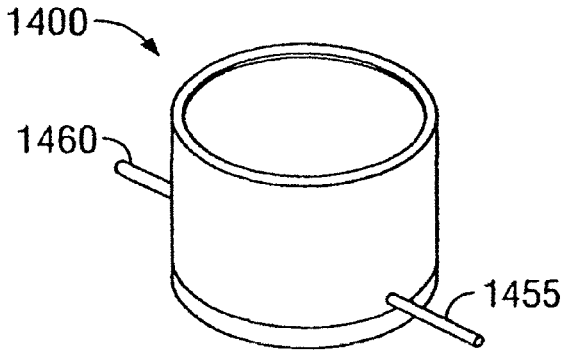
FIG. 14A is a perspective view of the annular evaporator of FIG. 11.
Figure 14B:
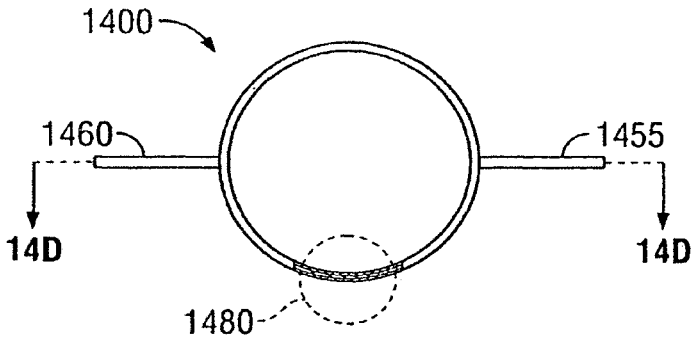
FIG. 14B is a top and partial cutaway view of the annular evaporator of FIG. 14A.
Figure 14C:
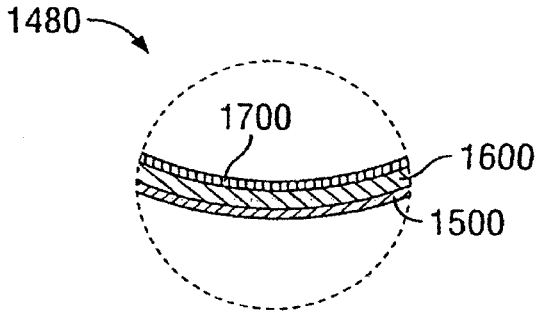
FIG. 14C is an enlarged cross-sectional view of a portion of the annular evaporator of FIG. 14B.
Figure 14D:
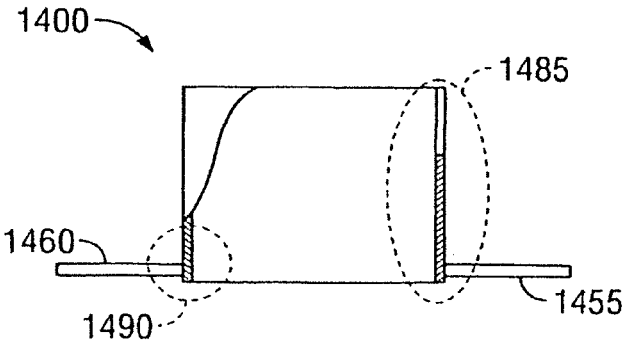
FIG. 14D is a cross-sectional view of the annular evaporator of FIG. 14B taken along section line 14D-14D.
Figure 14E:
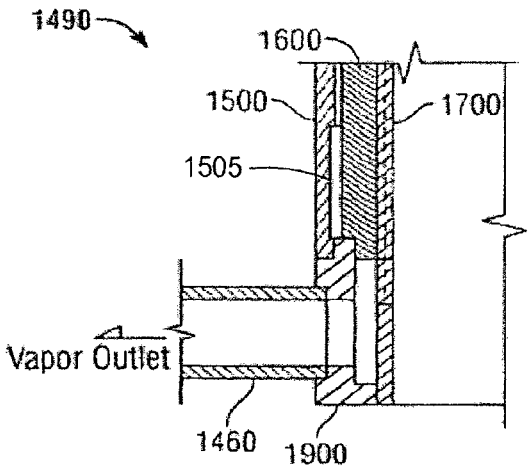
FIGS. 14E and 14F are enlarged views of portions of the annular evaporator of FIG. 14D.
Figure 14F:
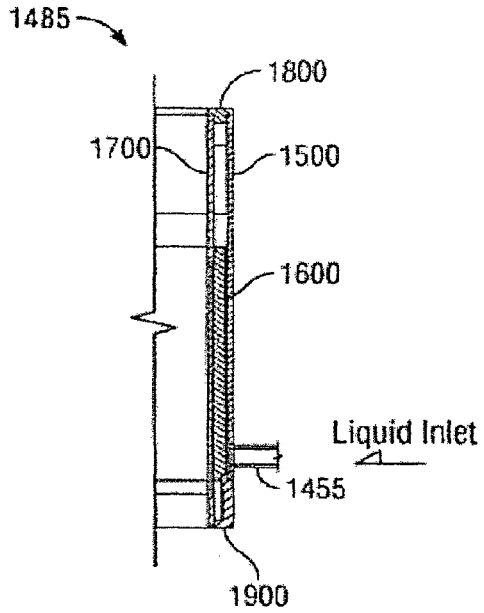
Figure 15A:
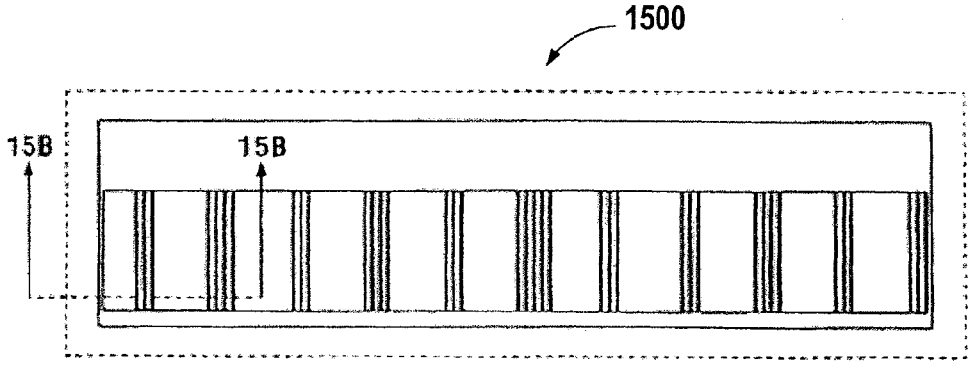
FIG. 15A is a flat detail view of the heated wall formed into a shell ring component of the annular evaporator of FIG. 14A.
Figure 15B:
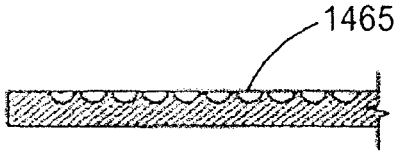
FIG. 15B is a cross-sectional view of the heated wall of FIG. 15A taken along section line 15B-15B.
Figure 16A:
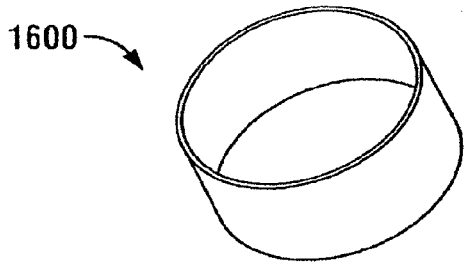
FIG. 16A is a perspective view of a primary wick of the annular evaporator of FIG. 14A.
Figure 16B:
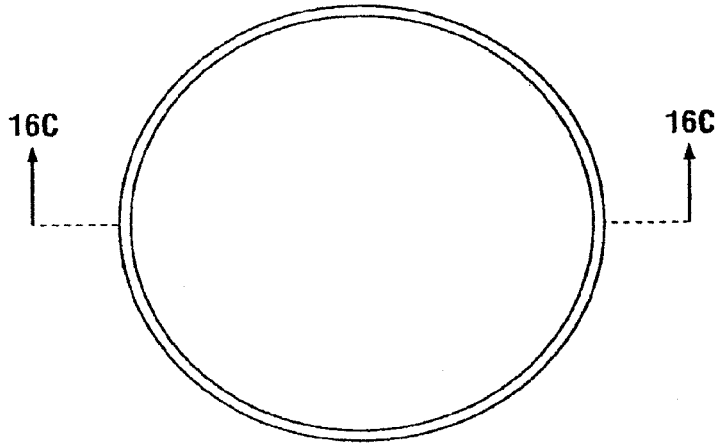
FIG. 16B is a top view of the primary wick of FIG. 16A.
Figure 16C:
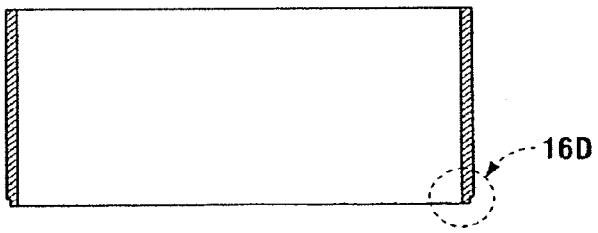
FIG. 16C is a cross-sectional view of the primary wick of FIG. 16B taken along section line 16C-16C.
Figure 16D:
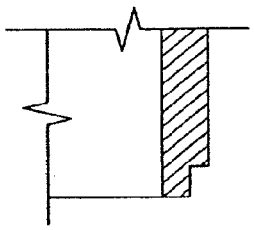
FIG. 16D is an enlarged view of a portion of the primary wick of FIG. 16C.
Figure 17A:
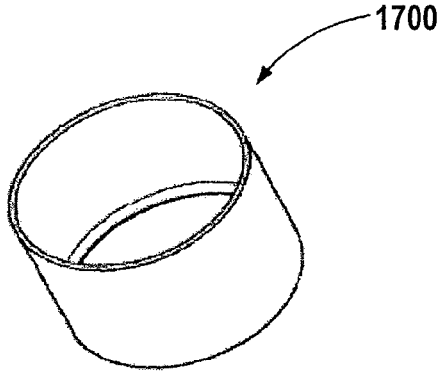
FIG. 17A is a perspective view of a liquid barrier wall formed into an annular ring of the annular evaporator of FIG. 14A.
Figure 17B:
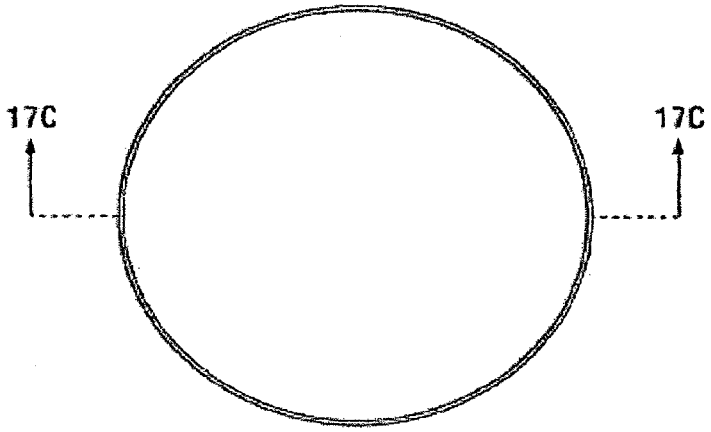
FIG. 17B is a top view of the liquid barrier wall of FIG. 17A.
Figure 17C:
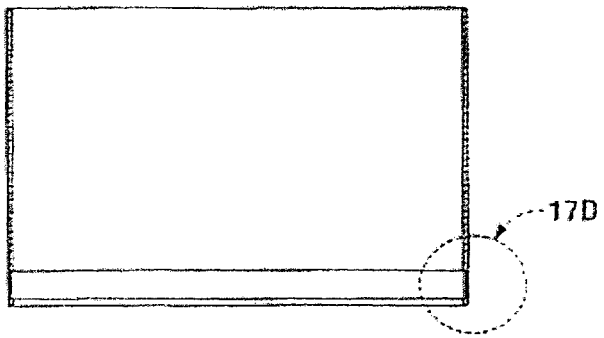
FIG. 17C is a cross-sectional view of the liquid barrier wall of FIG. 17B taken along section line 17C-17C.
Figure 17D:
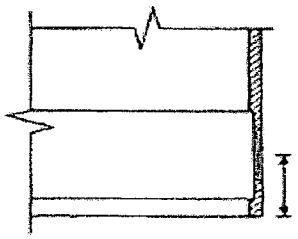
FIG. 17D is an enlarged view of a portion of the liquid barrier wall of FIG. 17C.
Figure 18A:
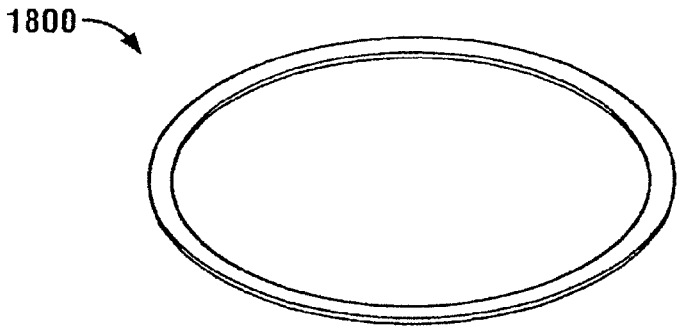
FIG. 18A is a perspective view of a ring separating the liquid barrier wall of FIG. 17A from the heated wall of FIG. 15A.
Figure 18B:
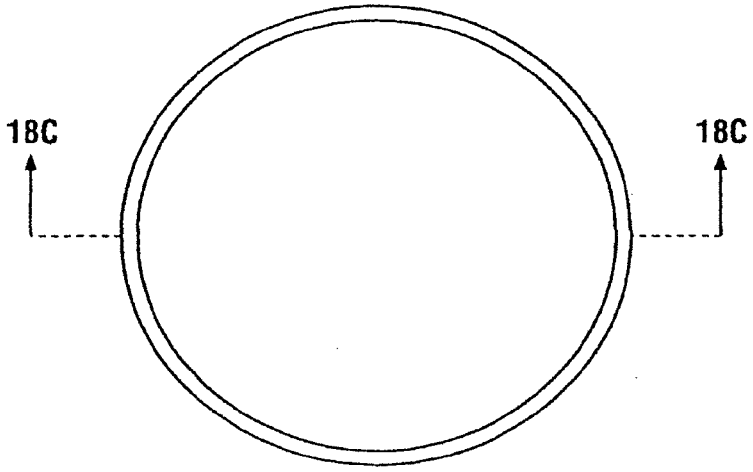
FIG. 18B is a top view of the ring of FIG. 18A.
Figure 18C:
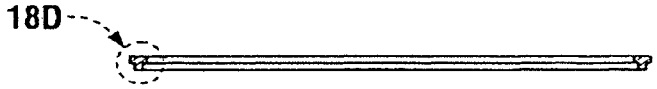
FIG. 18C is a cross-sectional view of the ring of FIG. 18B taken along section line 18C-18C.
Figure 18D:
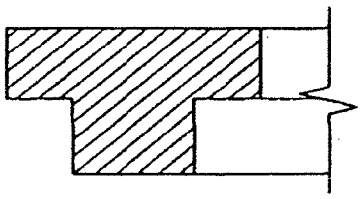
FIG. 18D is an enlarged view of a portion of the ring of FIG. 18C.
Figure 19A:
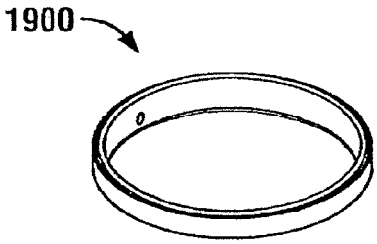
FIG. 19A is a perspective view of a ring of the annular evaporator of FIG. 14A.
Figure 19B:
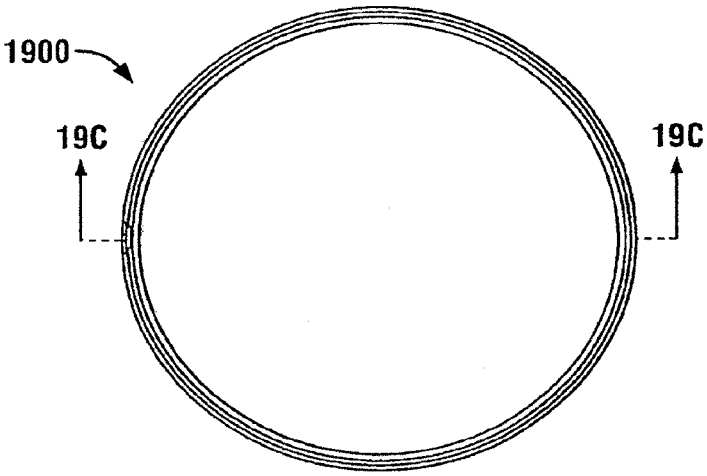
FIG. 19B is a top view of the ring of FIG. 19A.
Figure 19C:
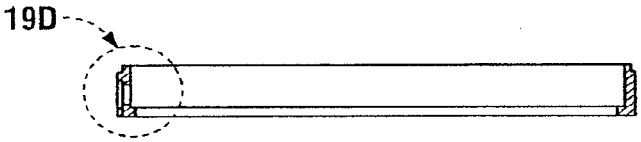
FIG. 19C is a cross-sectional view of the ring of FIG. 19B taken along section line 19C-19C.
Figure 19D:
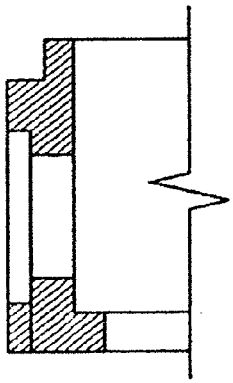
FIG. 19D is an enlarged view of a portion of the ring of FIG. 19C.

Referring also to FIGS. 14A-14F, an annular evaporator 1400 is shown having a liquid inlet 1455 and a vapor outlet 1460. The annular evaporator 1400 includes a heated wall 1700 (FIGS. 14E, 14F, 15A, and 15B), a liquid barrier wall 1500 (FIGS. 14E, 14F, and 17A-D), a primary wick 1600 (FIGS. 16A-16D) positioned between the heated wall 1700 and the inner side of the liquid barrier wall 1500, vapor removal channels 1465 (FIGS. 15A and 15B), and liquid flow channels 1505 (FIG. 14E). The annular evaporator 1400 also includes a ring 1800 (FIGS. 18A-18D) that ensures spacing between the heated wall 1700 and the liquid barrier wall 1500 and a ring 1900 (FIGS. 19A-19D) at a base of the evaporator 1400 that provides support for the liquid barrier wall 1500 and the primary wick 1600.

The evaporators disclosed herein can operate in any combination of materials, dimensions and arrangements, so long as they embody the features as described above. There are no restrictions other than criteria mentioned here; the evaporator can be made of any shape, size and material. The only design constraints are that the applicable materials be compatible with each other and that the working fluid be selected in consideration of structural constraints, corrosion, generation of noncondensable gases, and lifetime issues.

Other implementations are within the scope of the following claims.

What is claimed is:

1. A method of making an evaporator, the method comprising:

orienting a heated wall having a planar shape to define at least a portion of an exterior surface of the evaporator with a heat-absorbing surface of the heated wall configured to receive heat;

orienting a liquid barrier wall having a planar shape configured to confine liquid adjacent the heated wall;

positioning a wick between the heated wall and the liquid barrier wall;

defining at least one vapor removal channel at an interface between the wick and the heated wall;

defining at least one liquid flow channel between the liquid barrier wall and the wick; and defining a vapor vent channel substantially between the wick and the liquid barrier wall proximate the at least one liquid flow channel, the vapor vent channel sized and configured to remove vapor bubbles from the wick.

2. The method of claim 1, wherein defining at least one liquid flow channel between the liquid barrier wall and the wick comprises forming the at least one liquid flow channel in at least one of an inner surface of the liquid barrier wall and an outer surface of the wick.

3. The method of claim 1, further comprising orienting a subcooler adjacent the liquid barrier wall.

4. The method of claim 1, wherein defining at least one vapor removal channel at an interface between the wick and the heated wall comprises forming the at least one vapor removal channel in at least one of an inner surface of the heated wall and an outer surface of the wick and wherein defining at least one liquid flow channel between the liquid barrier wall and the wick comprises forming the at least one liquid flow channel in at least one of an inner surface of the liquid barrier wall and the outer surface of the wick.

5. The method of claim 1, wherein:

defining at least one liquid flow channel between the liquid barrier wall and the wick comprises forming the at least one liquid flow channel in one of an inner surface of the liquid barrier wall and the outer surface of the wick; and defining a vapor vent channel substantially between the wick and the liquid barrier wall proximate the at least one liquid flow channel comprises forming the vapor vent channel in the other one of the inner surface of the liquid barrier wall and the outer surface of the wick.

6. The method of claim 1, wherein defining at least one vapor removal channel at an interface between the wick and the heated wall comprises forming the at least one vapor removal channel in at least one of an inner surface of the heated wall and an outer surface of the wick.

7. The method of claim 6, further comprising electroetching the at least one vapor removal channel into the heated wall.

8. The method of claim 6, machining the at least one vapor removal channel into the heated wall.

9. A method of making an evaporator, the method comprising:

orienting a heated wall such that a heat-absorbing surface of the heated wall defines at least a portion of an exterior surface of the evaporator configured to receive heat;

orienting a liquid barrier wall configured to confine liquid adjacent the heated wall;

positioning a primary wick between the heated wall and the liquid barrier wall;

defining at least one vapor removal channel at an interface between the primary wick and the heated wall;

defining at least one liquid flow channel between the liquid barrier wall and the primary wick; and positioning a secondary wick between the at least one liquid flow channel and the primary wick.

10. The method of claim 9, further comprising defining a vapor vent channel at an interface between the secondary wick and the primary wick.

11. The method of claim 9, further comprising forming the heated wall and the liquid barrier wall into a planar shape.

12. The method of claim 9, further comprising forming the heated wall and the liquid barrier wall into an annular shape.

13. The method of claim 12, further comprising positioning the heated wall inside of and coaxial with the liquid barrier wall.

14. The method of claim 13, further comprising forming a plurality of fins on an outer surface of the liquid barrier wall.

15. The method of claim 13, further comprising positioning the primary wick to be coaxial within the liquid barrier wall and the heated wall.

16. A method of making an evaporator, the method comprising:

defining at least a portion of an exterior surface of the evaporator with a heat-absorbing surface of a heated wall configured to receive heat;

positioning a wick to extend between the heated wall and a liquid barrier wall positioned proximate the heated wall and configured to confine liquid;

forming at least one liquid flow channel in at least one of an inner surface of the liquid barrier wall and a surface of the wick;

forming at least one vapor removal channel in at least one of an inner surface of the heated wall and another surface of the wick;

positioning a secondary wick between the wick and the at least one liquid flow channel; and forming a vapor vent channel at an interface between the secondary wick and the wick configured to remove vapor bubbles from the wick.

17. The method of claim 16, further comprising forming fins on an outer surface of the liquid barrier wall.

18. The method of claim 16, further comprising selecting the wick to exhibit a planar shape.

19. The method of claim 18, further comprising selecting the heated wall and the liquid barrier wall to both exhibit a planar shape.

* * * * *